US006560790B2

(12) United States Patent
Saar et al.

(10) Patent No.: US 6,560,790 B2
(45) Date of Patent: May 13, 2003

(54) FLUSH CONTROL

(75) Inventors: David A. Saar, Titusville, NJ (US); Dwight N. Johnson, Carlsbad, CA (US)

(73) Assignee: Geberit Technik AG, Jona (CH)

( * ) Notice: Subject to any disclaimer, the term of this patent is extended or adjusted under 35 U.S.C. 154(b) by 56 days.

(21) Appl. No.: 09/800,288

(22) Filed: Mar. 6, 2001

(65) Prior Publication Data

US 2002/0162166 A1 Nov. 7, 2002

(51) Int. Cl.[7] ..... E03D 13/00

(52) U.S. Cl. ..... 4/302; 4/304; 4/313; 251/129.04; 137/110

(58) Field of Search ..... 4/302, 303, 304, 4/305, 313, 314; 251/129.04, 129.03; 137/110, 601.14

(56) References Cited

U.S. PATENT DOCUMENTS

| | | | | |
|---|---|---|---|---|
| 4,309,781 A | | 1/1982 | Lissau | |
| 4,793,588 A | | 12/1988 | Laverty, Jr. | |
| 4,805,247 A | | 2/1989 | Laverty, Jr. | |
| 4,894,874 A | * | 1/1990 | Wilson | 251/129.04 |
| 4,916,762 A | | 4/1990 | Shaw | |
| 4,989,277 A | | 2/1991 | Tsutsui et al. | |
| 5,431,181 A | * | 7/1995 | Saadi et al. | 137/15.11 |
| 5,469,586 A | | 11/1995 | Tsutsui et al. | |
| 5,482,250 A | | 1/1996 | Kodaira | |
| 5,508,510 A | | 4/1996 | Laverty, Jr. et al. | |
| 5,549,273 A | * | 8/1996 | Aharon | 251/129.04 |
| 5,769,120 A | | 6/1998 | Laverty, Jr. et al. | |
| 5,806,556 A | | 9/1998 | Johnson | |
| 6,041,809 A | | 3/2000 | Johnson | |
| 6,202,227 B1 | * | 3/2001 | Gurowitz | 4/313 |
| 6,212,697 B1 | * | 4/2001 | Parsons et al. | 250/216 |
| 6,321,785 B1 | * | 11/2001 | Bergmann | 137/606 |

* cited by examiner

*Primary Examiner*—Michael Powell Buiz
*Assistant Examiner*—Huyen Le
(74) *Attorney, Agent, or Firm*—Greer, Burns & Crain, Ltd.; Philip M. Kolehmainen

(57) ABSTRACT

A high flow valve assembly and a low flow valve assembly are in parallel flow relation between an inlet and an outlet of a flush controller. The valve assemblies are opened by solenoid operated pilot valves under the control of a microprocessor based flush control system. A turbine directly measures flow through the low flow valve assembly by providing pulses to the microprocessor, and the control system counts pulses and computes flow through the high flow valve assembly to perform a flushing operation including an initial siphon trap flushing high flow portion and a subsequent trap reseal low flow portion. Corrections are made to the pulse count to correct for partial valve open conditions and other variables. An override switch provides a signal to the control system for a flush operation A user detection system includes a pair of emitters and a pair of detectors defining an array of intersecting detection points in a skewed plane in which the control system can locate the position of a user. The controller can be configured for supplying flush water for either a toilet or a urinal, and for either right or left side water supply entry and the control system detects the unique connections to tailor the operation to the specific configuration.

29 Claims, 18 Drawing Sheets

FIG. 7
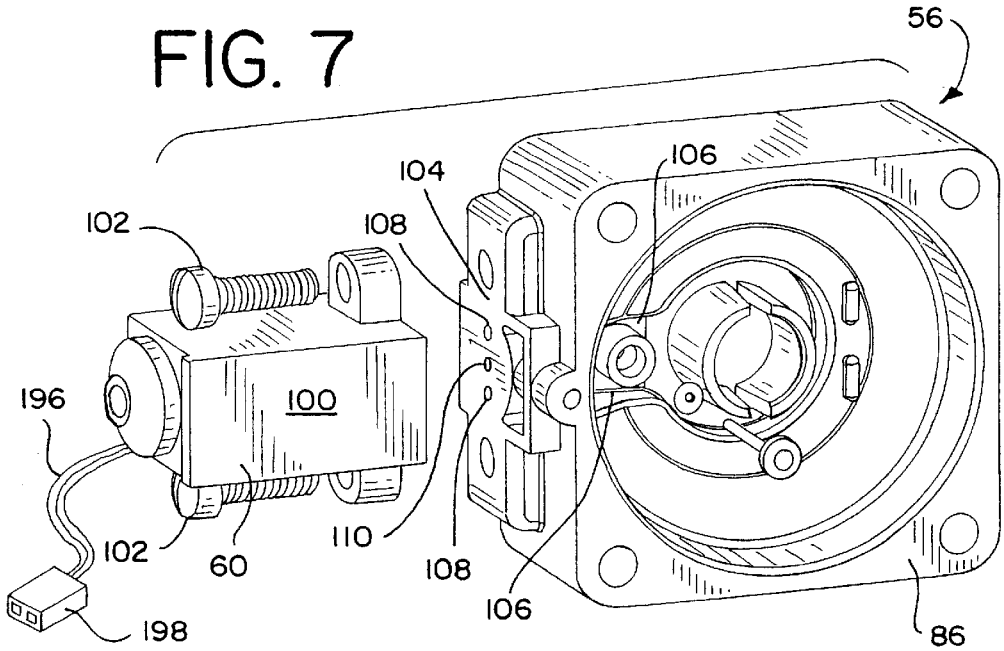
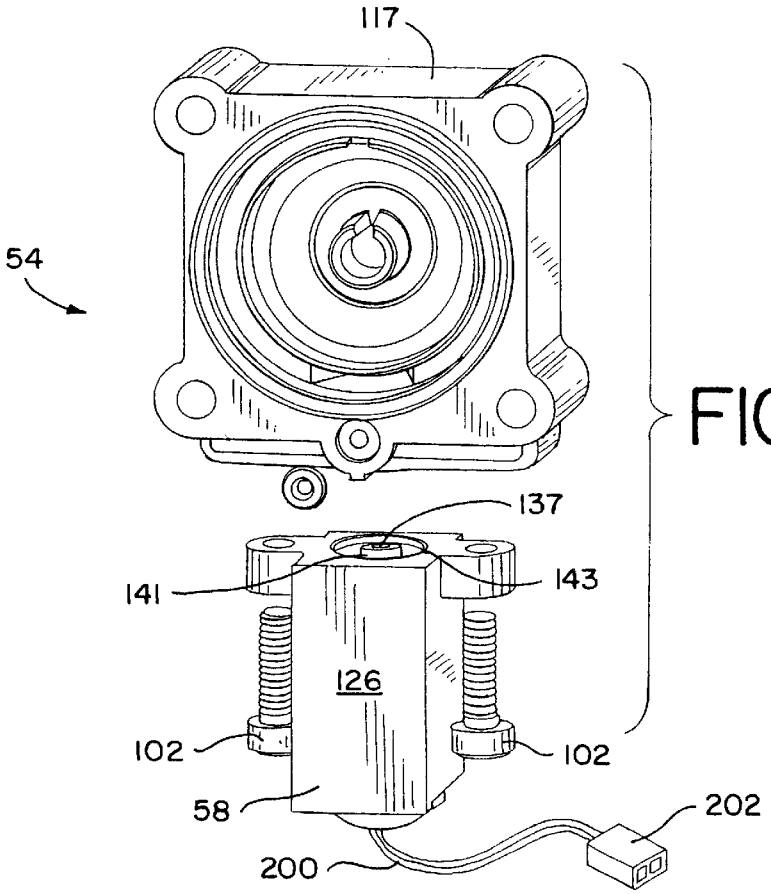
FIG. 8

RATE OF FLOW (GPM)
20
15
10
5
257A
257C
257D
257E
0
5
10
TIME (SEC.)

30
28
FLOW SENSOR
34
216
218
220
222
32
MICROPROCESSOR
33
MEMORY
I.R SENSOR
214
L.E.D.
212
182
187
188
196
H.F. SOL.
60
198
210
204
208
39
36
206
200
L.F. SOL.
58
190
202

FLUSH CONTROL

FIELD OF THE INVENTION

The present invention relates to improvements in controlling the flushing of toilets and urinals.

DESCRIPTION OF THE PRIOR ART

Known metering valves for flushing toilets and urinals typically include a slow closing valve mechanism for delivering a metered volume of water to a fixture. This type of valve does not achieve precise control of the flow rate or volume. The result can be excessive water consumption and poor flushing performance. To overcome such problems, there have been efforts to directly measure and control water flow in flush controllers.

U.S. Pat. No. 4,916,762 discloses a metered water control system for flush tanks including a water wheel turned by flow through a valve and a mechanical system including a gear and a notched cam for closing the valve after flow of a predetermined quantity of water.

U.S. Pat. No. 4,989,277 discloses a toilet flushing device including a flow rate sensor for detecting a flow rate that is compared with a programmed value read from memory. A flow rate control valve is operated in accordance with the comparison to provide a programmed flow rate pattern.

U.S. Pat. No. 5,806,556 discloses a metering valve including a flow turbine for measuring flow through an opened valve. Rotation of turbine wheel is transmitted to a cam through a reducing gear assembly and a lost motion connection in order to close the valve after a predetermined flow volume.

U.S. Pat. No. 6,041,809 discloses a flush control valve assembly with a burst valve for providing a larger, siphoning flow and a bypass valve for providing a smaller, trap reseal flow. The duration and flow volume of the larger flow is determined by the characteristics of the burst valve components, and the duration and flow volume of the smaller flow are determined by a flow turbine, a gear assembly and a control mechanism.

U.S. Pat. No. 5,469,586 discloses a flushing device including a microprocessor for operating a single variable flow valve at varied flow rates to provide stepped variations in flow. Flow rate patterns including urinal and toilet flush patterns are stored in memory. Other microprocessor based flushing systems are disclosed in U.S. Pat. Nos. 5,508,510 and 5,769,120

These prior art arrangements have not solved the problem of precise, adjustable flow control, particularly for siphon flush toilet applications where the fixture is supplied with an initial burst of water for siphon flushing and a subsequent low flow for trap reseal. It would be desirable to provide a flush controller that can accurately measure water flow and that can be precisely controlled to avoid unnecessary water consumption and to provide effective flushing action.

Known automated fixture flushing systems include the capability for sensing the presence of a user. The goal is to determine when use of the sanitary fixture has terminated so that the fixture can be flushed after use.

U.S. Pat. Nos. 4,793,588 and 4,805,247 disclose flush valve systems having an infra red sensor mechanisms including an infra red transmitter and an infra red receiver.

U.S. Pat. No. 5,482,250 discloses a flushing device with first and second infra red sensing systems. One of these systems detects the presence of a user at a sanitary fixture, and the other detects the presence of the hand of a user in a different region and permits the user to manually initiate a flush operation. A refracting element is used to bend the infra red beam a desired angle toward a toiler user region.

U.S. Pat. No. 4,309,781 discloses an automatic flushing system with an infra red light emitting diode light source and a photosensor. A lens system includes a lens angled to prevent false activation from reflective surfaces. Light reflected from the source to the photosensor by a proximate user for a preselected time results in initiation of a flush operation.

Performance of these known systems is inconsistent because the presence and amount of reflected light is dependent on extraneous factors such as reflection characteristics of different types of clothing and the like. Adjustment of sensitivity is necessary. Increased sensitivity can result in false readings, and reduced sensitivity can result in the failure to detect a user when present. It would be desirable to provide a flush controller having a user detection system that operates reliably despite reflectivity variations and that is able not only to detect the presence of a user in a detection area, but also to locate the position of the user within the area.

Known metering flush controllers of the type including slow acting valve mechanisms can be configured to supply a urinal or a toilet by selecting specific components of the valve mechanism to provide the needed flow characteristic. Known valves of this type can be connected to a water supply at the right or the left side. Electronically operated systems have not had these capabilities. It would be desirable to provide a flush controller that can be configured by the selection, orientation and location of components for toilet or urinal applications with right or left water entry.

SUMMARY OF THE INVENTION

A principal object of the invention is to provide improved methods for controlling a flush controller for a sanitary fixture. Other objects are to provide a method for accurately metering flow through a valve assembly having low and high flow valves by measuring flow through the low flow valve and computing total flow by correcting for non linear flow when the high flow valve is partly open; to provide a method for not only detecting but also for locating the position of a user in a user detection field in front of a sanitary fixture; to provide a method for configuring a flush controller for toilet or urinal control with right or left water entry and for detecting the configuration and initializing a control system accordingly; and to provide flush control methods overcoming shortcomings in known flush control arrangements.

In brief, in accordance with the invention there is provided a method for flushing a sanitary fixture including opening a low flow valve between a water supply and the sanitary fixture and opening a high flow valve between the water supply and the sanitary fixture. The method includes keeping a running count of flow through the low flow valve and commanding a closing the high flow valve when the running count reaches a closing count. The closing count is developed by using a baseline count derived from a proportional flow relationship between the valve open flow rates of the high and low flow valves, and from an added correction factor to account for nonproportional flows when the high flow valve is partly open.

In brief, in accordance with the invention there is provided a method for detecting a user in a user detection field in front of a flush controller for a sanitary fixture. The method includes emitting light into the user detection field and sensing the amounts of light reflected from spaced locations in the user detection field. A ratio of the sensed amounts is determined The ratio is used to locate a user in the user detection field.

In brief, in accordance with another aspect of the invention there is provided a method for configuring and operating a flush controller for toilet or urinal control with right or left water inlet. The method includes positioning a valve assembly so that an inlet of the valve assembly is directed either to the right or to the left for a corresponding right or left water inlet connection. A circuit board having an array of electrical terminals is oriented in one of two positions for a right or left water inlet connection respectively. Electrical components of the valve assembly are interconnected to selected terminals of the circuit board in a plurality of different connection patterns for a plurality of different flush controller configurations. The array of circuit board terminals is tested to detect a connection pattern corresponding to a flush controller configuration and a flush controller operating system is initialized with information about the connection pattern.

BRIEF DESCRIPTION OF THE DRAWING

The present invention together with the above and other objects and advantages may best be understood from the following detailed description of the preferred embodiment of the invention illustrated in the drawings, wherein:

FIG. 7 is an exploded isometric view of the high flow valve body and solenoid;

FIG. 8 is an exploded isometric view of the low flow valve body and solenoid;

DETAILED DESCRIPTION OF THE PREFERRED EMBODIMENTS

Figure 1:
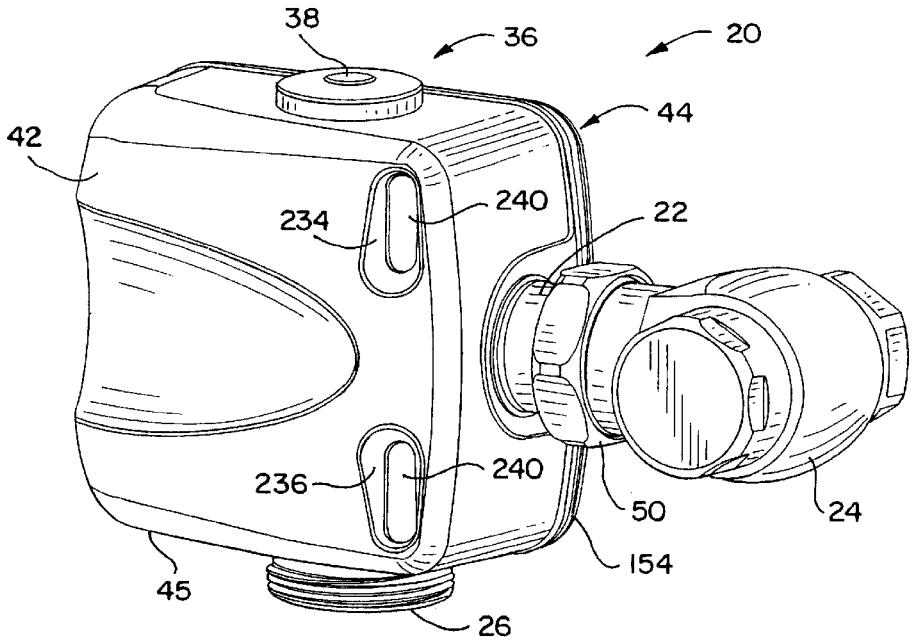
FIG. 1 is an isometric front and side view of a flush controller constructed in accordance with the present invention.
Figure 2:
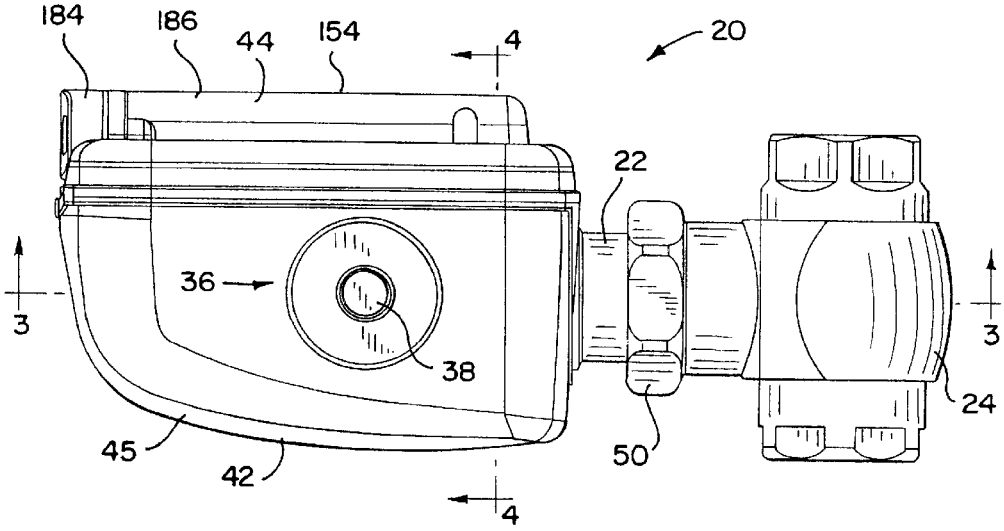
FIG. 2 is a top view of the flush controller.
Figure 3:
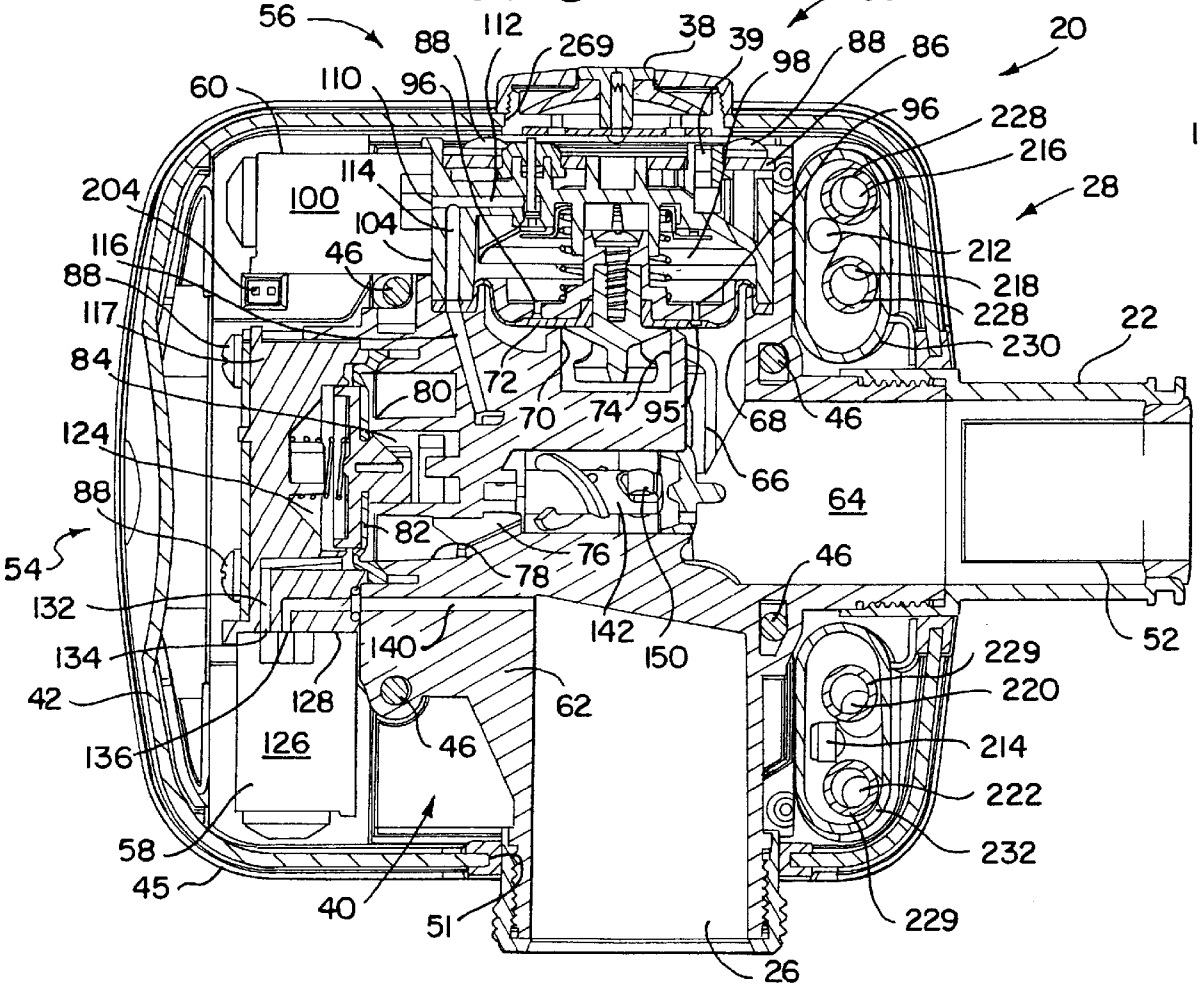
FIG. 3 is a cross sectional view of the flush controller taken along the line 3—3 of FIG. 2, with the control stop omitted.

Having reference now to the drawings and initially to FIGS. 1–3 there is illustrated a flush controller constructed in accordance with the principles of the present invention and designated as a whole by the reference character 20. The flush controller 20 includes an inlet port 22 connected by a manually adjustable control stop 24 to a supply of pressurized water, and an outlet port 26 that is connected to a sanitary fixture, such as a urinal or toilet.

The flush controller 20 supplies water for flushing either a urinal or a toilet in a non-residential application, for example a hotel, stadium, airport, or other location where a high volume water supply is present and a gravity flush tank is not needed. In a urinal application the flush controller 20 delivers a measured quantity of water at a constant flow rate during each flush cycle. For a siphon jet or blow out toilet fixture, the flush controller 20 initially delivers a short burst of water at a high flow rate to flush the fixture, and then delivers a measured volume of water at a lower flow rate to reseal the fixture trap.

Figure 9:
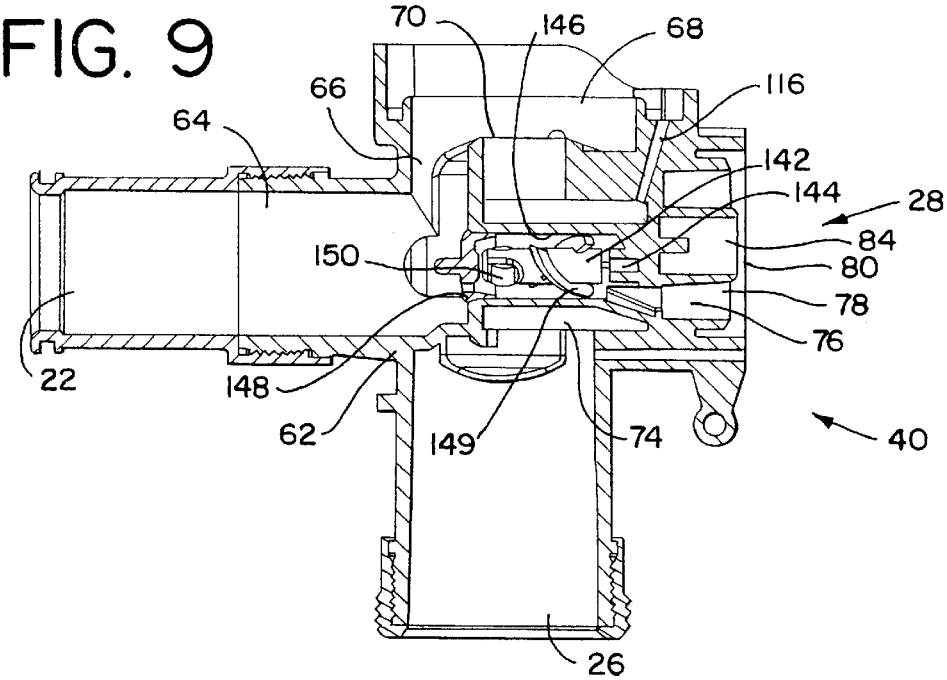
FIG. 9 is a cross sectional view of the body of the valve body assembly, taken along a central plane of the body and from a direction opposite to the cross sectional view of FIG. 3.
Figure 15:
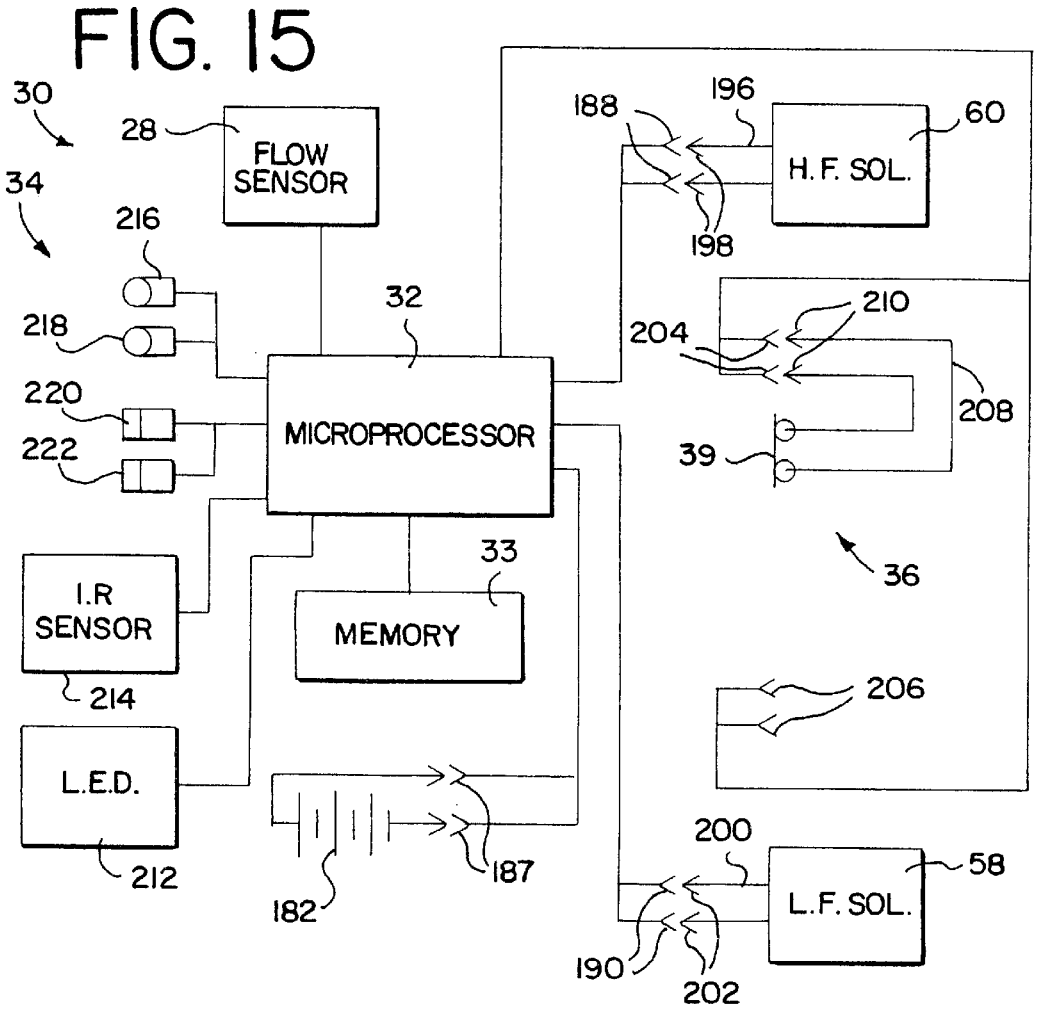
FIG. 15 is a schematic block diagram of the microprocessor based flush control system of the flush controller.
Figure 16:
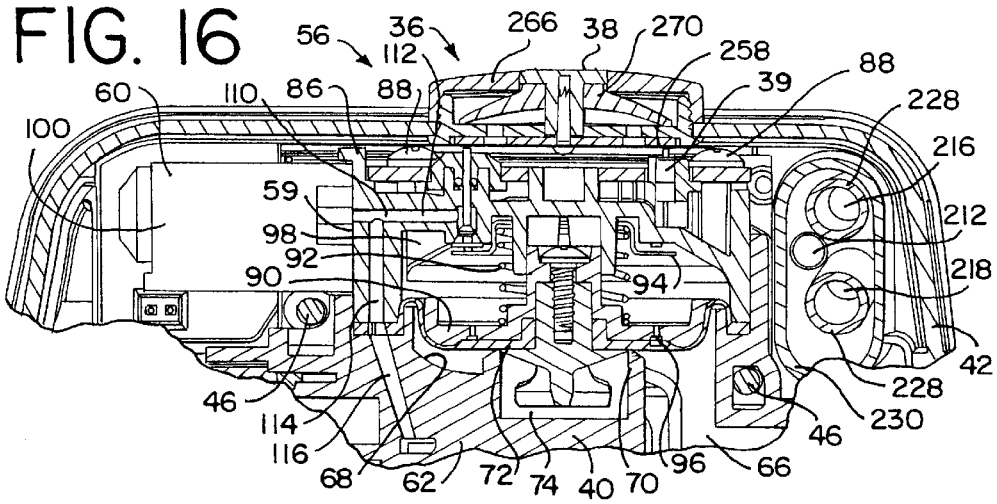
FIG. 16 is an enlarged fragmentary cross sectional view, similar to the upper portion of FIG. 3, showing the high flow valve assembly in its closed condition and the override control in a standby, non-actuated condition.

An automatic flush control system 30 including a microprocessor 32 including and/or having access to a memory 33 (FIG. 15) cooperates with a user detection system 34 (FIGS. 4, 13, 15, 21 and 22) for initiating and controlling a flush cycle after use of the fixture. A flow sensing assembly 28 (FIGS. 3, 9 and 15) provides a flow rate signal to the flush control system 30. A manually operated flush override control 36, including a pushbutton 38 and an override switch 39 (FIGS. 3 and 15–19), permits the user to override the automatic system 30 and initiate a normal flush operation or, alternatively, to operate the flush controller in a continuous high flow condition for setup or emergencies such as circuit or battery failure. The control system 30 is illustrated in FIG. 15 in a simplified, block diagram form. For clarity, components of the control system 30, such as solenoid drivers, power supplies, analog to digital converters and amplifiers, that are not needed for an understanding of the invention are omitted.

In general, the flush controller 20 includes a valve body assembly 40 sandwiched between a front cover 42 and a back plate assembly 44 (FIG. 5) cooperating to define a housing 45 (FIG. 1). Fasteners 46 hold the assembly 40, the front cover 42 and a gasket 48 in place. The gasket 48 includes lobes 48A and 48B (FIG. 5) for sealing around the inlet and outlet ports 22 and 26. The inlet port 22 is provided with a strainer filter 52. The manually adjustable control stop 24 (FIGS. 1 2 and 5) is mounted to the inlet port 22 by a coupling nut 50 and can be used for setting the maximum flow rate through the flush controller to achieve a high flow rate while avoiding splashing in the sanitary fixture. The outlet port 26 extends downwardly through an opening 51 in the bottom wall of the front cover 42 (FIG. 3).

Water flows from the inlet port 22 to the outlet port 26 along two parallel flow paths, one including a low flow valve assembly 54 and the other including a high flow valve assembly 56. These valve assemblies are operated respectively by low and high flow solenoid pilot valves 58 and 60. Referring to FIG. 3, a body 62 of the valve body assembly 40 includes an inlet chamber 64 communicating with the inlet port 22. A passage 66 extends from the chamber 64 to a high flow valve cavity 68 including a high flow valve seat 70. Flow through the seat 70 is normally prevented by a resilient high flow valve member 72 engaged with the seat 70. When the high flow valve member 72 is moved to an open position, water flows through an outlet passage 74 to the outlet port 26.

Another passage 76 extends from the inlet chamber 64 to a low flow valve cavity 78 including a low flow valve seat 80. Flow through the seat 80 is normally prevented by a resilient low flow valve member 82 engaged with the seat 80. When the low flow valve member 82 is moved to an open position, water flows through an outlet passage 84 to the outlet port 26.

The high flow valve cavity 68 is defined between the valve body 62 and a high flow valve cap 86 attached by fasteners 88. A diaphragm backing plate 90 overlies the high flow valve member 72, and a spring 92 in compression between the plate 90 and a spring seat 94 applies a force to initially close the valve member 72 in sealing relation against the high flow valve seat 70. When pressurized water is present at the inlet port 22, passage 66 and cavity 68, a restricted passage 95 in the valve member 72 communicating with apertures 96 in the plate 90 admits pressurized liquid to a control chamber region 98 above the valve member 72. Because the outlet passage 74 is at low pressure, the force differential across the valve member 72 resulting from pressurization of the control chamber 98 normally holds the valve member 72 against the valve seat 70 and prevents flow through the high flow valve assembly 56.

The high flow solenoid pilot valve 60 is energized by the control system 30 to open the high flow valve assembly 56. A high flow solenoid housing 100 is held by fasteners 102 against a wall 104 of the valve cap 86. Normally the high flow solenoid pilot valve 60 is in a closed condition. When the solenoid pilot valve 60 is energized, the solenoid pilot valve 60 is operated to an open position, permitting flow. A pair of upstream passages 106 extend from the normally pressurized control chamber 98 to control chamber ports 108 in the wall 104. A discharge port 110 in the wall 104 is spaced from the ports 108 and communicates with the outlet port 26 through intersecting passages 112 and 114 in the valve cap 86 and a passage 116 in the valve body 62. Energization of the solenoid pilot valve 60 interconnects ports 108 and 110 and vents the control chamber 98 to the outlet port 26 through passages 106, 108, 112, 114 and 116. The decrease in pressure in the control chamber 98 permits inlet pressure in the cavity 68 to move the valve member 72 to an open position, spaced away from the valve seat 70, and water flows at a high flow rate from the inlet port 22 to the outlet port 26 through the high flow valve assembly 56.

The low flow valve cavity 78 is defined between the valve body 62 and a low flow valve cap 117 attached by fasteners 88. A backing plate 118 overlies the low flow valve member 82, and a spring 120 in compression between the plate 90 and the cap 117 applies a force to initially close the valve member 82 in sealing relation against the low flow valve seat 80. When pressurized water is present at the inlet port 22, passage 76 and cavity 78, a restricted bleed passage 122 in the valve member 82 admits pressurized liquid to a control chamber region 124 behind the valve member 82. Because the outlet passage 84 is at low pressure, the force differential across the valve member 82 resulting from pressurization of the control chamber 124 normally holds the valve member 82 against the valve seat 80 and prevents flow through the low flow valve assembly 54.

The low flow solenoid pilot valve 58 is energized by the control system 30 in order to open the low flow valve assembly 54. A low flow solenoid housing 126 is held by fasteners 102 against a wall 128 of the valve cap 117. Normally the low flow solenoid pilot valve 58 is in a closed condition. When the solenoid pilot valve 58 is energized, the solenoid pilot valve 58 is operated to an open position, permitting flow. An upstream passage 132 extends from the normally pressurized control chamber 124 to a control chamber port 134 in the wall 128. A discharge port 136 in the wall 128 is spaced from the port 134 and communicates with the outlet port 26 through passages 138 and 140 in the valve cap 117 and the valve body 62. Energization of the solenoid pilot valve 58 interconnects ports 134 and 136 and vents the control chamber 124 to the outlet port 26 through passages 138 and 140. The decrease of pressure in the control chamber 124 permits inlet pressure in the cavity 78 to move the valve member 82 to an open position, spaced away from the valve seat 80, and water flows at a low flow rate from the inlet port 22 to the outlet port 26 through the low flow valve assembly 54.

Figure 26:
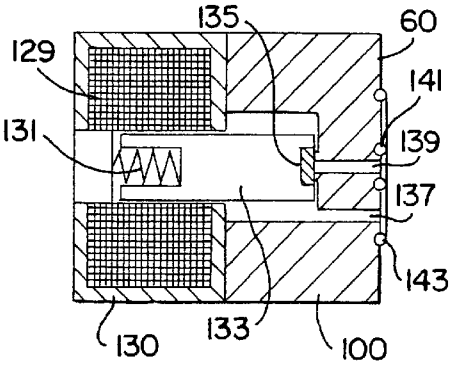
FIG. 26 is a simplified cross sectional view of a solenoid pilot valve of the flow controller.

FIG. 26 illustrates the high flow solenoid valve 60. The low flow solenoid valve 58 is of the same construction. The housing 100 of the solenoid valve 60 supports a solenoid winding 129 on a spool 130. A spring 131 normally holds a plunger 133 in sealing relation against a valve seat 135. When the solenoid winding 129 is energized the plunger 133 is pulled away from the seat 135 to permit flow from an inlet port 137 to an outlet port 139. Concentric O-rings 141 and 143 isolate the ports 137 and 139 from one another when the body 100 is mounted against a flat wall surface.

The flow sensing assembly 28 (FIG. 9) detects the volume of flow and the rate of flow through the low flow valve assembly 54. The assembly 28 is a turbine meter system including a turbine spool 142 mounted for rotation on an axially extending support pin 144 within a turbine chamber 146. The chamber 146 is located in the flow path between the inlet chamber 64 and the passage 76. An apertured plate 148 restricts the flow of water and directs the flow toward spiral blades 149 on the spool 142. When water flows through the chamber 146, the spool 142 rotates at a speed directly proportional to the flow rate over a wide range of water pressure and flow rates. A magnet 150 is carried by the spool 142, and a Hall effect sensor 152 (FIG. 10) in close proximity to the magnet 150 provides an output signal to the flush control system 30 for each rotation of the turbine spool.

The back plate assembly 44 (FIGS. 5 and 10–12) includes a back cover 154 and an electronics enclosure 156. A circuit board 158 and the enclosure 156 have complementary H shapes and the board 158 is attached to the rear of the enclosure 156 by fasteners 160 (FIG. 11). The board 158 has a central portion 162 supporting circuit components including the microprocessor 32 (FIG. 10) and the Hall effect sensor 152, and the central portion 162 is flanked by elongated side leg board portions 164 and 166. The Hall effect sensor 152 is positioned at an elevated, central position above the surface of the board 158, and when the board 158 is secured to the electronics enclosure 156, the sensor 152 is received in a forwardly projecting sensor well 168 formed on a pedestal 169 as an integral portion of the enclosure 156.

The body 62 of the valve body assembly 40 has open windows 170 formed in its opposite sides. As seen by comparing FIGS. 5 and 6, the window 170 at the front side of the body 62 is closed by a bulkhead member 172 and gasket 174 held in place by fasteners 176. Fasteners 178 (FIG. 5) attach the back plate assembly 44 with the enclosed circuit board 158 to the valve body assembly 40. When the assembled back plate assembly 44 is mated with the valve body assembly 40, the sensor well 168 and the pedestal 169 enter the window 170 at the back side of the body 62. A second gasket 174 (FIG. 5) provides a seal between the pedestal 169 and the window 170. In this mated position, the sensor well 168 and the Hall effect sensor 152 in the well are located immediately adjacent to the rotational path of the magnet 150 as the turbine spool 142 is rotated by the flow of water through the low flow valve assembly 54. The sensor 152 provides an output pulse for each rotation of the turbine spool 142.

Power for the flush controller 20 is provided by batteries 182 held in a battery cartridge 184. The cartridge 184 is slideably received in a battery chamber 186 formed in the rear of the back cover 154. When cartridge 184 is installed, contact is made with a pair of battery terminals 187. The terminals 187 are mounted upon the rear surface of the circuit board 158 at the intersection of the central portion 162 and the side leg 166, and extend rearwardly into the chamber 186.

Pairs of solenoid terminal pins 188 and 190 are supported by the circuit board 158 near the opposite ends of the side leg 164. These contacts are accessible through access ports 192 and 194 in the front wall of the electronics enclosure 156. With the back plate assembly 44 installed in the orientation seen in FIGS. 3, 5 and 6, the terminal pins 188 and the port 192 are located near the top of the flow controller 20 and the terminal pins 190 and the port 194 are located near the bottom of the flow controller 20. The high flow solenoid 60 has a cable 196 terminating in a female connector 198 seen only in FIG. 7. The connector 198 is mated with the terminal pins 188 in order to connect the solenoid 60 into the flush control system 30 (FIG. 15). The high flow solenoid 60 is positioned near the top of the flush controller 20, and the cable 196 is not long enough to reach the lower pin terminals 190. The low flow solenoid 58 has a cable 200 terminating in a female connector 202 seen only in FIG. 8. The connector 202 is mated with the with the terminal pins 190 in order to connect the solenoid 58 into the flush control system 30. The low flow solenoid 58 is positioned near the bottom of the flush controller 20, and the cable 200 is not long enough to reach the upper pin terminals 188. As a result of the orientation of the components and the length of cables 196 and 200, the solenoids 58 and 60 (in the configuration of FIG. 5) are only capable of being connected in this one, unique way to the circuit board 158.

Two pairs of override switch terminal pins 204 and 206 are also supported by the circuit board 158 along the side leg 164. The pins 204 are located near the solenoid terminal pins 188 at the top of the flow controller 20, and the pins 206 are located near the solenoid terminal pins 190 at the bottom of the flow controller 20. The terminal pins 204 and 206 are accessible through access ports 205 and 207 in the front wall of the electronics enclosure 156. A cable 208 terminating in a female connector 210 is connected to the override switch 39. With the back plate assembly 44 installed in the orientation seen in FIGS. 3, 5 and 6, the connector 210 is mated with the terminal pins 204 in order to connect the override switch 39 into the flush control system 30 (FIG. 15). The cable 208 is not long enough to permit the connector 210 to reach the lower terminal pins 206, and the connection can only be made in one way.

An LED light source 212 is supported on the side leg 166 of the circuit board 158. The LED 212 is energized, preferably in a flashing mode, by the flush control system 30 to provide an indication of the need for replacement of the batteries 182 near the end of their battery life. An infra red sensor 214 is also supported on the side leg 166 of the circuit board 158. The sensor 214 can be used to receive infra red signals from an infra red emitter associated with a remote device.

The user detection system 34 includes a plurality of infra red emitters and a plurality of infra red detectors permitting detection of reflected light over a pattern of locations in a user detection field 247. As seen in broken lines in FIG. 4, an outer infra red emitter 216 and an inner infra red emitter 218 are located near the top of the controller 20 in the orientation of FIG. 1. An inner infra red detector 220 and an outer infra red detector 222 are located near the bottom of the flush controller 20 in the orientation of FIG.

Figure 4:
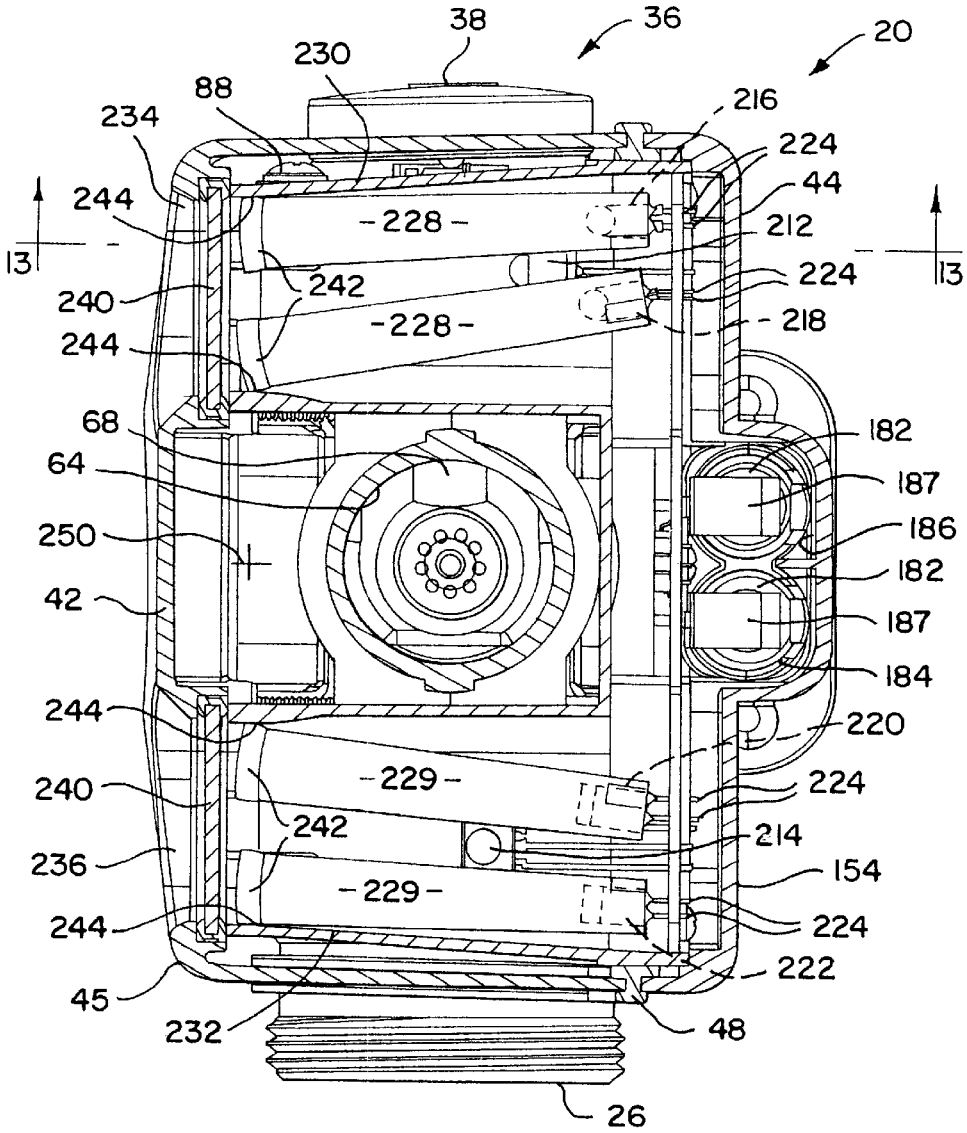
FIG. 4 is a cross sectional view of the flush controller taken along the line 4—4 of FIG. 2.
Figure 13:
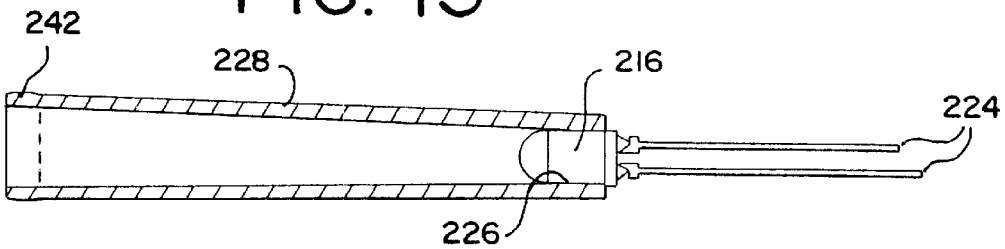
FIG. 13 is an enlarged cross sectional view of an infra red emitter and sight tube, taken along the line 13—13 of FIG. 4.

The emitters 216, 218 and the detectors 220, 222 have leads 224 that are connected to the side leg portion 166 of the circuit board 158. The emitters and detectors 216, 218, 220 and 222 can be directly connected to the circuit board 158 by through hole soldering as shown, or alternatively may be socketed or connected directly or indirectly by other techniques such as surface mounting. Each emitter 216, 218 is received in a neck portion 226 of an elongated, slightly tapered sight tube 228 (FIG. 13). Each detector 220, 222 is received in a neck portion 226 of an elongated slightly tapered sight tube 229. The emitters 216, 218 with their corresponding sight tubes 228 are located within the base of a first open topped support tower 230 formed as part of the electronics enclosure 156 (FIG. 4). The detectors 220, 222 with their corresponding sight tubes 229 are located within the base of another open topped support tower 232 also formed as part of the electronics enclosure 156.

A pair of windows 234 and 236 are formed in the front cover 42 at the front of the flush controller 20. The open tops of the towers 230 and 232 are aligned with the windows 234 and 236. To maintain a sealed environment within the flush controller 20, a transparent window panel 240 is received in each window 234 and 236. The sight tubes 228 and 229 within the towers 230 and 232 are directed along lines extending from the emitters and detectors 216, 218, 220, 222 through the windows 234 and 236. Under the control of the flush control system 30, light is emitted from the emitters 216, 218 to the user detection field 247 in front of the flush controller 20 through the sight tubes 228 and window 234. When a user of the flush controller 20 is in the field 247, light is reflected to the detectors 220, 222 through the window 236 and sight tubes 229. The light reflection information is used by the flush control system 30 to initiate a flush cycle after use of the sanitary fixture.

The sight tubes 228, 229 narrowly focus the emitters 216, 218 and the detectors 220, 222. Each sight tube 228, 229 is provided with a bead portion 242 at the open ends opposite the necks 226. These beads 242 are in the shape of part of a sphere. The beads 242 are received between ribs 244 (FIG. 4) in the towers 230 and 232 in a connection that permits each sight tube 228, 229 to pivot around its forward end. The pivot points defined by the beads 242 of the sight tubes 228 and 229 are approximately aligned in a common plane. The pivotal mounting of the sight tubes 228, 229 provides an advantage in the design and manufacture of the flush controller 20 because the sight tubes 228, 229 can be aimed to optimize the performance of the user detection system 34. When the leads 224 are positioned and secured upon the circuit board 158, for example by soldering or by insertion into sockets soldered to the board, the positions of the sight tubes 228, 229 are fixed. In the design of the board, the mounting positions on the circuit board 158 are located in order to obtain the desired sight or focus lines for light emitted from the emitters 216, 218 and for light reflected toward the detectors 220, 222. Changing the sight lines requires only a change in the circuit board mounting locations.

Figures 21, 22, 24:
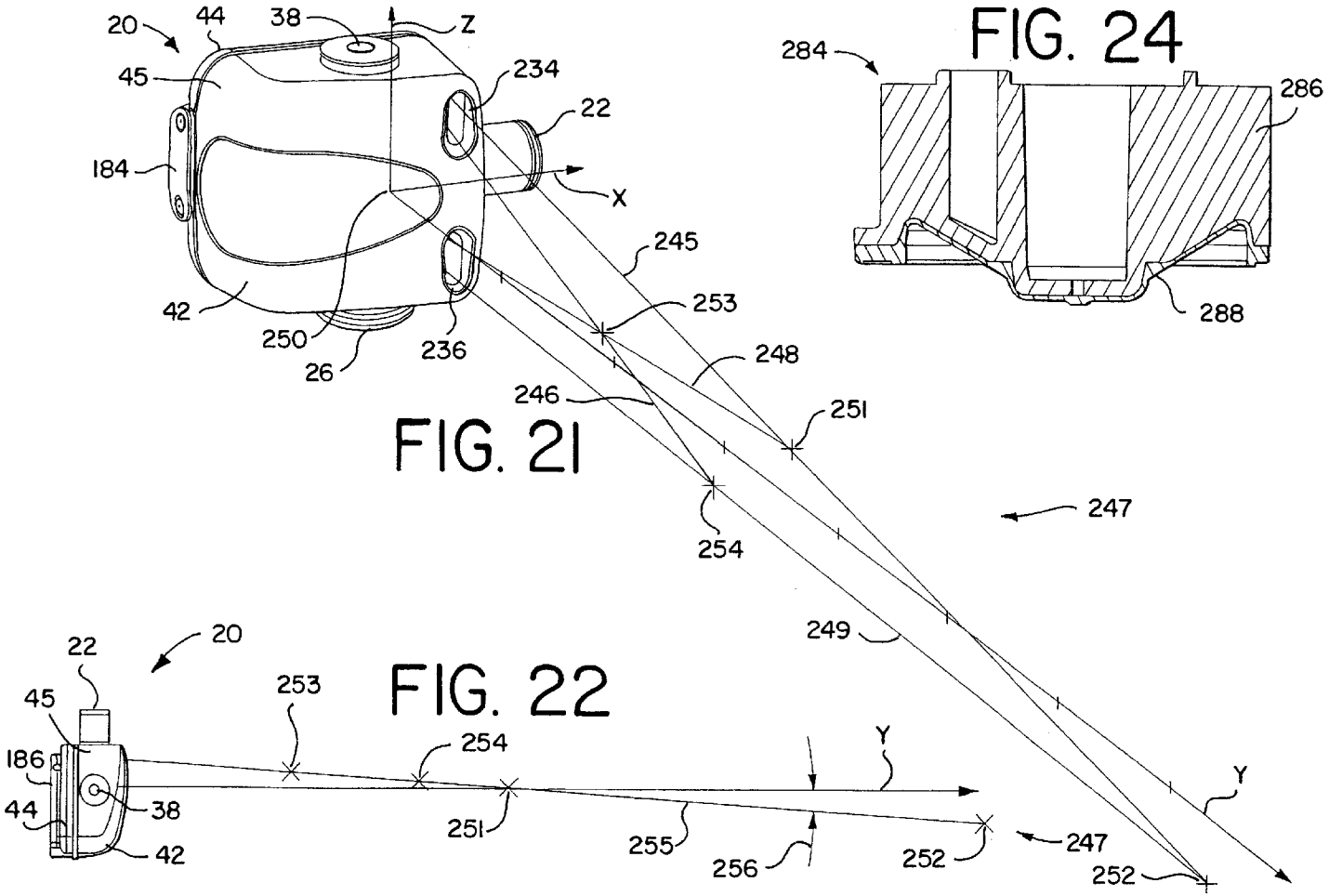
FIG. 21 is an isometric view of the flush controller showing the focus lines of the emitters and detectors of the user detection system.
FIG. 22 is a top view on a reduced scale of the flush controller and focus lines of FIG. 21.
FIG. 24 is a vertical cross sectional view of a valve body plug assembly used when the flush controller is configured to flush a urinal as seen in FIG. 23.

As seen in FIG. 21, focus lines 245 and 246 respectively for the emitters 216 and 218 pass outwardly through the window 234 into the user detection field 247 in front of the flush controller 20. Focus lines 248 and 249 respectively for the detectors 220 and 222 pass through the window 236 into the user detection field 247. The lines 245, 246, 248 and 249 are arrayed in space in a rectilinear X-Y-Z coordinate system indicated by X, Y and Z arrows in FIG. 21. The origin 250 of these coordinates is located approximately in the same general plane as the pivot points of the sight tubes 228, 229 (FIG. 4) and the Y axis extends through the intersection of the axes of the inlet port 22 and the outlet port 26. The X axis extends from the origin 250, side to side with respect to the housing 45, parallel to the axis of the inlet port 22. The Z axis extends from the origin 250, up and down with respect to the housing 45, parallel to the axis of the outlet port 26. The Y axis extends from the origin 250 forward from the housing 45 and into the user detection region 247.

The focus lines 245 and 246 for the emitters 216 and 218 are spaced apart and diverge at a small angle. The focus lines 248 and 249 for the detectors 220 and 222 also are spaced apart and diverge at a small angle. The focus line 245 for the emitter 216 intersects the focus line 248 for the detector 220 at an intersection point 251 and intersects the focus line 249 for the detector 222 at an intersection point 252. The focus line 246 for the emitter 218 intersects the focus line 248 for the detector 220 at an intersection point 253 and intersects the focus line 249 for the detector 222 at an intersection point 254. The emitters 216 and 218 and the detectors 220 and 222 are aimed and focused by the sight tubes 228 and 229 along narrow paths centered on the lines 245, 246, 248 and 249. These narrow paths intersect at tightly defined regions centered on the intersection points 251, 252, 253 and 254. Therefore the paths and intersection regions can be considered for purposes of description to be lines and points.

The flush control system 30 periodically energizes the emitter 216 to direct infra red light along the line 245 251. The control system 30 interrogates the detectors 220 and 222 for the presence of reflected infra red light from the emitter 216. The flush control system 30 also periodically energizes the emitter 218 to direct infra red light along the line 246. The control system 30 interrogates the detectors 220 and 222 for the presence of reflected infra red light from the emitter 218. When a user is present in the user detection field 247, infra red light is reflected by the user from the emitter 216 at points 251 and/or 252, and/or infra red light is reflected by the user from the emitter 218 at points 253 and 254. Reflected light from points 253 and 251 is detected by the detector 220 and reflected light from points 254 and 252 is detected by the detector 222.

As can be seen in the top view of FIG. 22, all four focus lines 245, 246, 248 and 249, and thus all four intersection points 251, 252, 253 and 254 lie in a common, generally vertically oriented, user detection plane 255 in the user detection field 247. This user detection plane is skewed with respect to the principal front-to back axis of the flush controller housing 45. As seen in FIG. 22, the plane 255 is offset a skew angle 256 from the Y axis and from the vertical plane defined by the Y and Z axes. In a preferred embodiment of the invention the angle 256 is four degrees. The skew angle 256 prevents false signal reflections from surfaces perpendicular to the Y axis, such as the surface of a door of a toilet stall.

The flush control system 30 detects the presence and the location of a user in the user detection region 247. The relative strengths of the reflected signals from the scattered points 251–254 provides information from which the placement of a user in the region 247 is determined. This information is used by the control system 30 to initiate a flush cycle at appropriate times, for example when a user enters the region 247, remains for a period of time, then leaves the region 247 and is absent for a period of time. The control system 30 uses ratios of relative reflected signal strength rather than simple magnitude alone. The use of ratios of reflection magnitudes from the pattern of points 251–254 renders the system relatively independent of sensitivity, and substantially cancels out the effect of reflection variations of different clothing fabrics and the like. The need for field calibration of the user detection system 34 is eliminated or reduced.

Figures 27, 28:
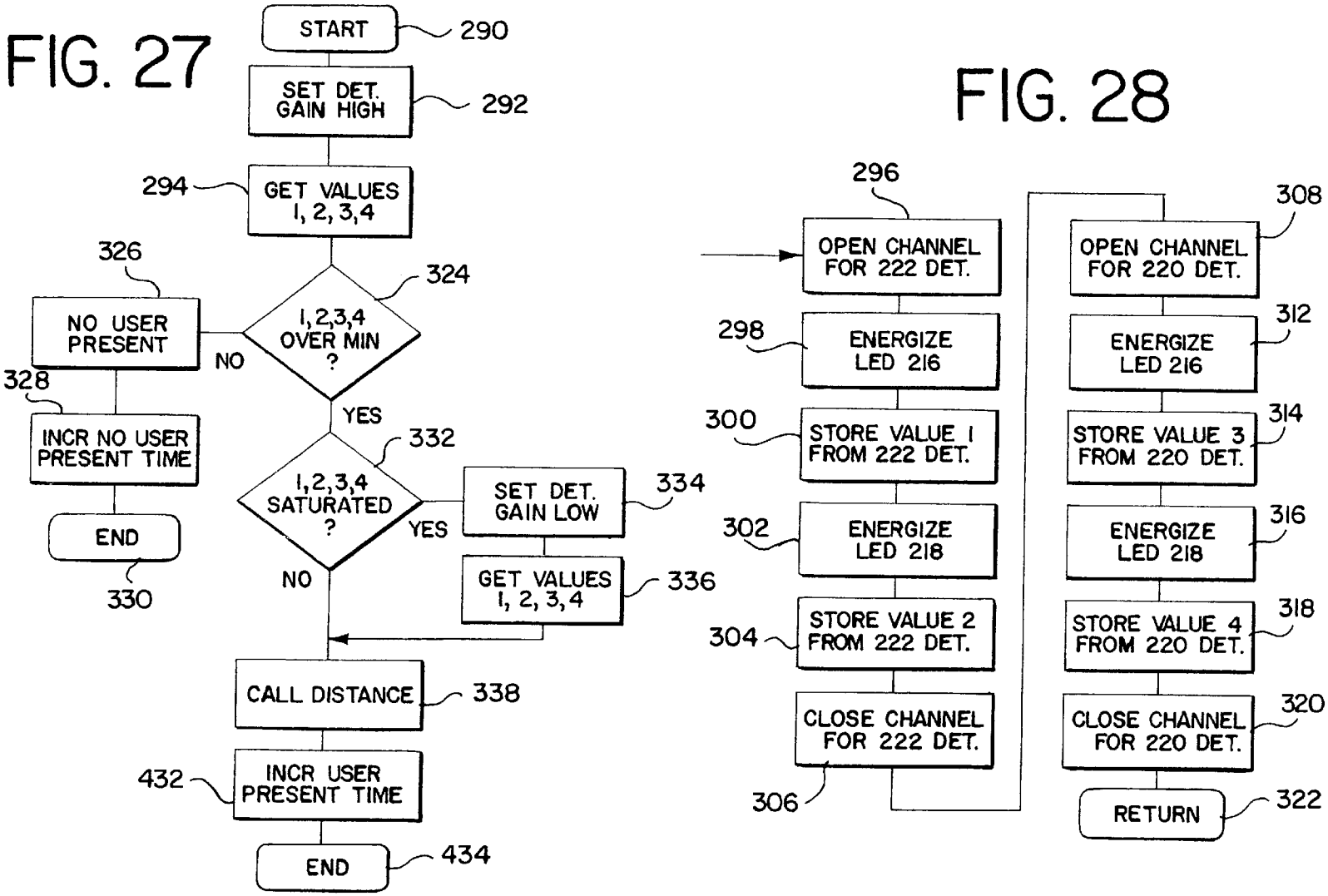
FIG. 27 is a flow chart of a routine for detecting the presence or absence of a user in a user detection field in front of the flush controller.
FIG. 28 is a flow chart of a subroutine of the routine of FIG. 27 for finding values corresponding to light reflected from an array of locations in the user detection field.
Figure 29:
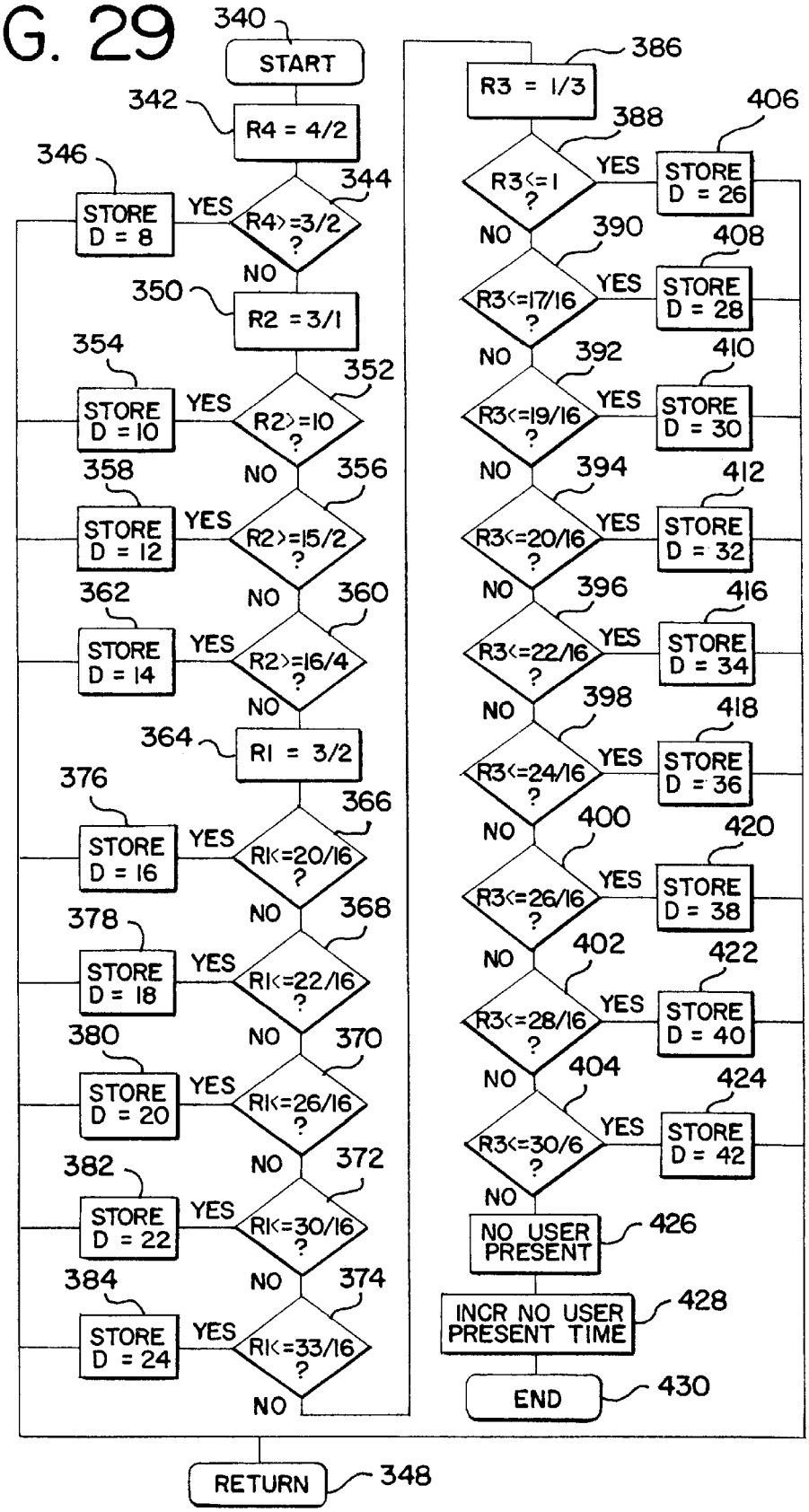
FIG. 29 is a routine for finding the location of a user within the user detection field.

More specifically, referring now to the flow charts in FIGS. 27–29, routines for detecting and locating a user in the detection field 247 is illustrated. These routines are performed in accordance with instructions contained in memory and implemented by the microprocessor 32. The routine of FIG. 27 is performed repeatedly at regular time intervals of, for example, about one second and starts at start block 290 of FIG. 27. At block 292, the gain of amplification is set to a normal, relatively high gain, in a channel for communicating signals from the detectors 220 and 222 to the microprocessor 32. The subroutine of FIG. 28 is called at block 294 of FIG. 27.

The subroutine of FIG. 28 is used to obtain values corresponding to the amounts of reflected light detected at points 251, 252, 253 and 254 in the user detection field 247. The subroutine begins at block 296 where a communication channel is opened from detector 222 to the microprocessor 32. When the channel is open, the emitter 216 is energized at block 298 and is permitted to stabilize. Then a value, designated as VALUE 1, is obtained from detector 222 and stored at block 300. This value corresponds to the reflected light sensed at point 252 in the field 247. Emitter 216 is deenergized and emitter 218 is energized at block 302 and allowed to stabilize. A VALUE 2 is obtained from detector 222 and stored at block 304. VALUE 2 corresponds to the reflected light sensed at point 254 in the field 247. The channel for detector 222 is closed at block 306

The subroutine continues at block 308 where a channel is opened for the detector 220. In blocks 312 and 314 a VALUE 3 is obtained from emitter 216 and detector 220. VALUE 3 corresponds to the reflected light sensed at point 251. In blocks 316 and 318 a VALUE 4 is obtained from emitter 218 and detector 220. VALUE 4 corresponds to the reflected light sensed at point 253 in the user detection field 247. At this point the four values corresponding to reflected light at points 252, 254, 251 and 251 are stored and the processing returns at block 322 to the routine of FIG. 27.

Each of the stored values is compared in decision block 324 with a small minimum reference. If none of the stored values exceed this reference amount, then the decision is made in block 326 that no user is present in the detection field 247. A NO USER PRESENT time count is incremented in block 328 and the main routine ends at block 330. The NO USER PRESENT time count is used by the microprocessor to total the elapsed time during which no user is detected in the field 247.

If any of the four stored values is larger than the minimum reference amount, then at decision block 332 the stored values are compared with a large maximum reference value. If any of the stored values exceed the maximum, then it is determined that the sensed signal is large enough to saturate the communication channel to the microprocessor. To prevent the resulting amplification non linearity from impairing the accuracy of the user detection and location routine, at block 334 the communication channel gain is set to a low gain value, with less channel gain that normally set at lock 292. Under low gain conditions, the subroutine of FIG. 28 is again called at block 336. In this iteration of the FIG. 28 subroutine, the four values previously stored are replaced with smaller values obtained with lower gain in the channels for detectors 222 and 220.

With the four values VALUE 1, VALUE 2, VALUE 3 and VALUE 4 determined and stored, the FIG. 27 routine at block 338 calls a DISTANCE routine starting at block 340 in FIG. 29. In general the DISTANCE routine calculates ratios of the four stored values and then compares these ratios with numbers that correspond to the presence of a user at specific locations in the user detection field 247. These numbers are preferably obtained by experience in sensing values and ratios with users or test objects located at known positions in the field 247. Because ratios are used in place of absolute reflected light magnitudes, the location computation is largely independent of extraneous factors such as reflectivity and ambient conditions.

At block 342 of FIG. 29, a ratio R4 is calculated. R$ is the ration of VALUE 4 to VALUE 2 and is a dimensionless number. At decision block 344, ratio R$ is tested against a referenced number "3/2". If R4 is greater than or equal to the reference number in block 344, then it is known that the user is positioned about eight inches from the flush controller 20. In block 346 a distance variable D is set to 8 and the routine then returns to the FIG. 27 routine from a return block 348. If R4 is not larger than or equal to the reference number "3/2" in block 344, then in block 350 a ratio R2, the ratio of VALUE 3 to VALUE 2 is calculated. In block 352, R2 is tested against a new reference number "10" and if R2 is greater than or equal to that reference number, the user is about ten inches from the flush controller 20, the value 10 is stored for variable D at block 354 and the routine returns at block 348. If the test of block 352 is not satisfied, then a new tests is made at block 356 to see if R2 is greater than or equal to the reference number "15/2" for a conclusion, stored as D equals 10 in block 358, that the user is about twelve inches from the flush controller 20. A similar test is made in block 360 of R2 against the reference number "16/4" and potential return through block 362 with storage of 14 at variable D. The reference numbers in the DISTANCE routine of FIG. 29 can take any desired form. The illustrated routine uses fractions because integers have an advantage in some circumstances as a programming convenience.

The routine continues in block 364 where the ratio of VALUE 3 to VALUE 2 is computed as ratio R1 and then tested in step by step fashion at a series blocks 366, 368, 370, 372 and 374 against a series of increasing larger reference numbers. At each step, if R1 is equal to or smaller than the reference number, then at the corresponding block 376, 378, 380, 382 or 384, the variable D is set to 16, 18, 20, 22 or 24 as an indication that the user is located about sixteen, eighteen, twenty, twenty-two or twenty-four inches from the flush controller 20. Similarly at block 386 the ratio R3 of VALUE 1 to VALUE 3 is calculated and tested step-by-step against a series of reference numbers of increasing values in blocks 388, 390, 392, 394, 396, 398, 400, 402 and 404. If any test is satisfied, then the corresponding distance variable D is stored with a return at block 348 through one of blocks 406, 408, 410, 412, 414, 416, 418, 420, 422 or 424.

The maximum distance value D of the DISTANCE routine is 42. Although other values could be used, in the illustrated arrangement, in order for a user to be considered present in the user detection field 247, the user must be at least as close as about forty-two inches to the flush controller 20. If none of the tests of the decision blocks in FIG. 29 is satisfied then it is concluded at block 426 that no user is present in the field 247, even though the minimum value test of block 324 in FIG. 27 is met. In this case the NO USER PRESENT time count is incremented in block 428 and the routine ends at block 430 of FIG. 29.

If any one of the ratios compared sequentially with reference numbers in the DISTANCE routine of FIG. 29 satisfies one of the step-by-step tests, then processing returns through block 348 to the main routine of FIG. 27 with the D variable set to an even number in the range of 8 to 42. This condition establishes that a user is present in the detection field 247. The user detection and location information obtained with this routine is available for use in the control system 30 for any desired purpose. In the illustrated arrangement, at block 432, a USER PRESENT time count is incremented and the routine ends at block 434.

A flush cycle is automatically commenced by the flush controller 20 under the control of the flush control system 30. In preferred implementation, the USER PRESENT and the NO USER PRESENT counts are employed in the control system 30 by the microprocessor 32 to determine that use is concluded of a sanitary fixture supplied by the flush controller 20. When a user is detected to be present in the field 247 for a first predetermined time, for example several seconds, and then when no user is determined to be present during an immediately following second period of time, for example several seconds, then a flush operation is initiated.

In a flush cycle for a toilet fixture, the flush controller delivers to the outlet port 26 a precisely metered volume of water including an initial short burst of water at a high flow rate to flush the fixture, followed after a period of transition by a delivery of water at a low flow rate to reseal the fixture trap. The initial short burst is provided by opening both the high flow valve assembly 56 and the low flow valve assembly 54. The high flow valve assembly 56 is then closed while the low flow valve assembly remains open to provide the low flow for resealing the fixture trap.

Figure 14:
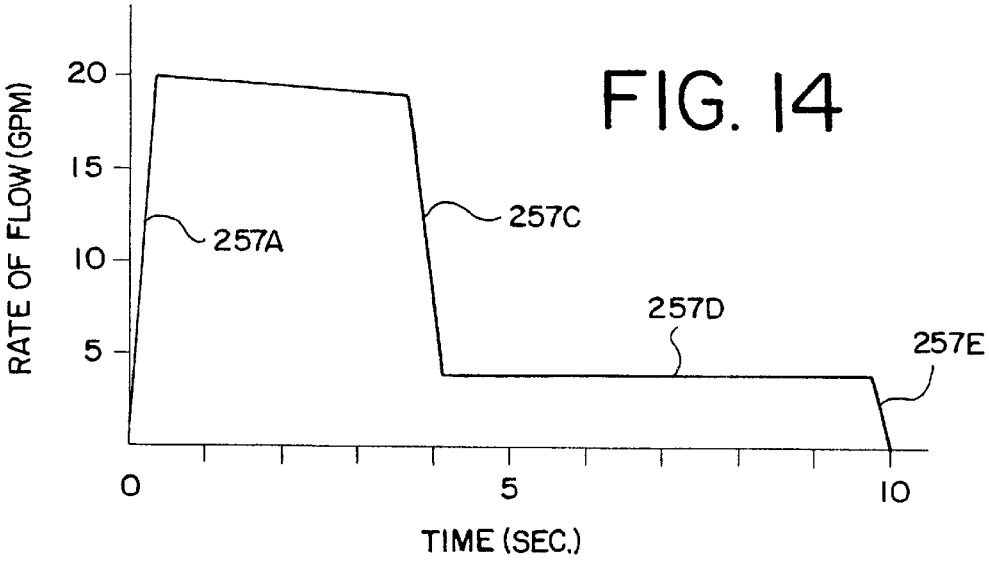
FIG. 14 is an idealized graphical representation of the water delivery profile of the flush controller for a flush cycle of a toilet fixture.

A an idealized representation of the flow of water through the flush controller 20 in a toilet fixture flush cycle is shown graphically by the flow rate vs. time line 257 in FIG. 14. A ten second flush cycle begins at time zero. Line segment 257A shows a rapid increase in flow from zero to a high flow rate of about twenty GPM in a small fraction of a second as the low and high flow solenoids 58 and 60 are energized to open the low and high flow valve assemblies 54 and 56. The high flow indicated by line segment 257B continues until somewhat less than four seconds into the flush cycle, when the high flow solenoid 60 is deenergized to close the high flow valve assembly 56. During the high flow period, about 1.2 gallons of water flows to the fixture. Line segment 257C represents the transition from high flow to low flow that takes place during the fraction of a second while the high flow valve assembly 56 closes. The low flow for trap reseal, indicated by line segment 257D, continues for about six seconds at a flow rate of about of about four GPM to supply about 0.4 gallons to the fixture. The line segment 257E illustrates the closing of the low flow valve assembly 54 after total flow of about 1.6 gallons. The representation of FIG. 14 is idealized to facilitate understanding of the invention, and in practice the line 257 may not have straight line segments and has rounded rather than sharp corners.

The flush control system 30 uses flow feedback signals from the flow sensor 28. The flow sensor 28 directly measures flow through the low flow valve assembly 54, and provides an accurate measurement of amount and rate of flow over a wide range of pressures and flow rates. When both the low flow and high flow valve assemblies 54 and 56 are open, water flows in parallel paths through these assemblies. Under steady state conditions when both the high and low flow valve assemblies 54 and 56 are open, the flow rates and quantities in the parallel paths are proportional in a fixed ratio determined by the flow restrictions in the two parallel paths. Therefore an accurate determination of flow through the high flow valve assembly is calculated by the flow control system 30 using the measured flow through the low flow rate valve assembly 54. The flow restrictions of the flow paths through the low and high flow valve assemblies 54 and 56, and thus their flow impedances, in a preferred embodiment of the invention are related by a ratio of one to eight. Thus when both valve assemblies 54 and 56 are open, the volume of flow through the high flow valve assembly 56 is larger than the volume of flow through the low flow valve assembly by a factor of eight.

The sensor 152 provides an electrical pulse to the control system 30 for each rotation of the turbine spool 142. In a preferred embodiment of the invention, the turbine spool 142 completes 2,070 revolutions and provides an output signal with 2,070 pulses for each one gallon of flow through the low flow valve assembly 54. When only the low flow valve assembly 54 is open, the flush control system 30 determines the rate and volume of flow by counting these pulses. When both the low and high flow valve assemblies 56 and 54 are open, the flush control system 30 determines the total rate and volume of flow by counting the flow signal pulses to measure flow through the low flow valve assembly 54 and by calculating the flow through the high flow valve assembly 56. This calculation is done using the eight to one flow ratio and using a transition algorithm stored in the memory 33 and implemented by the microprocessor 32 for determining flow through the high flow valve assembly when it is in transition, moving between open and closed positions as the high flow valve assembly 56 opens and closes. The low and high flows are added to calculate the total flow rate and volume. The resulting precise determination of water flow through the flush controller 20 permits accurate control throughout the entire flush cycle. The water flow in each stage of the flush cycle is accurately metered, and the total water flow for the cycle can be limited to a desired maximum. Flow during the high flow rate burst can be maximized while maintaining sufficient subsequent low flow for reliable fixture trap reseal, resulting in improved flushing performance.

When both the low and high flow valves assemblies 54 and 56 are fully open in a steady state condition, the proportional flow relationship between the low and high flows permits an accurate determination of the high flow and the total flow from the pulse count provided by the Hall effect sensor 152. However a significant amount of time is required to open or to close the high flow valve assembly 56 in response to a valve open or valve close in the form of energization or deenergization of the high flow solenoid pilot valve 60. During the opening and closing times, the flow through the high flow valve 56 is reduced and the high and low flows are not proportional. In addition, the opening and closing times are affected by the pressure drop when the high flow valve assembly 56 is open. Also, the opening and closing times are affected by supply pressure and by flow restrictions in the flow path, for example by the adjustment of the control stop 24.

Figure 30:
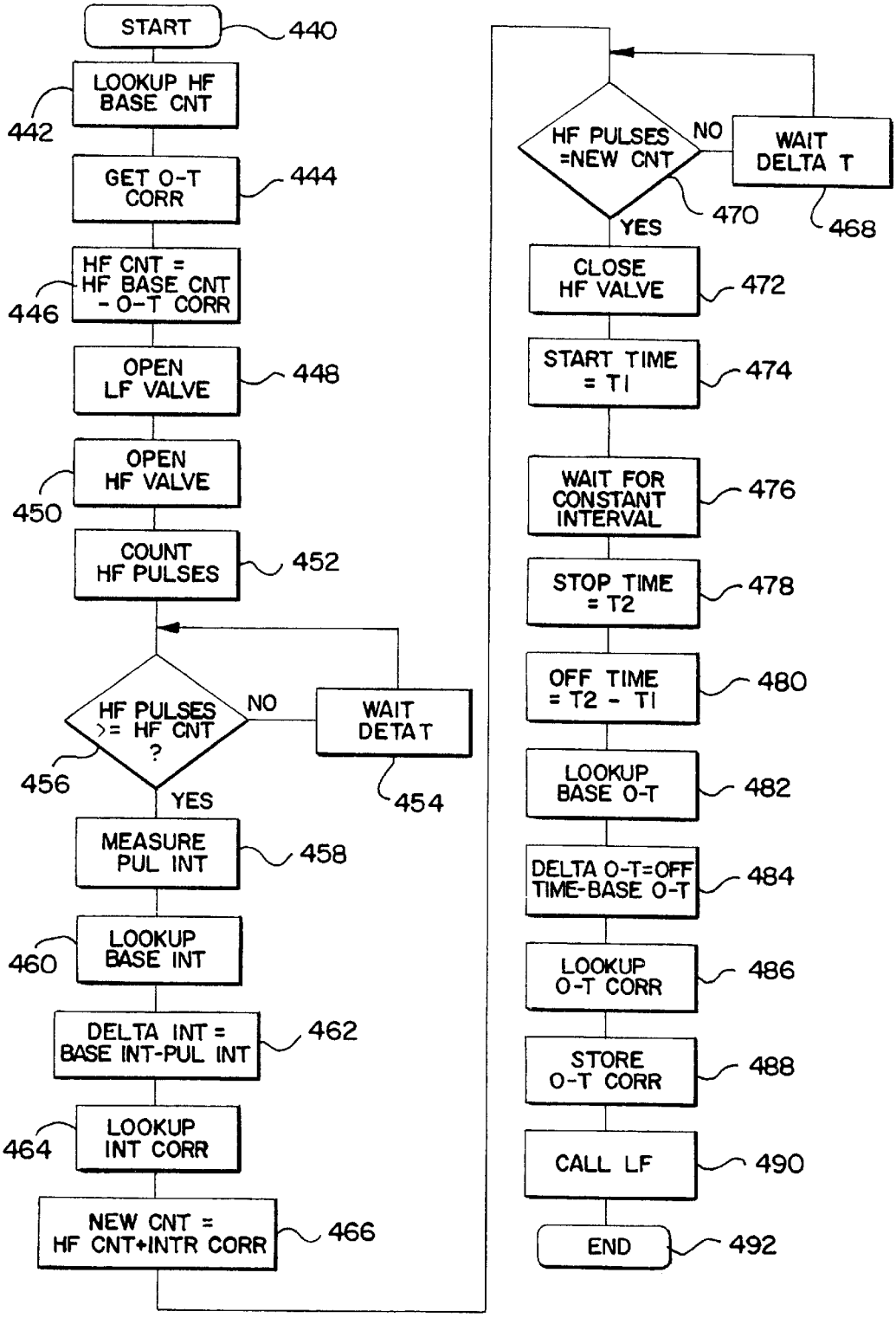
FIG. 30 is a flow chart of a routine for operating the flush controller to supply water to flush a toilet.

The control system 30 performs a flush control routine seen in the flow chart of FIG. 30 in order supply water to flush a toilet. The toilet flush routine is able to supply a precisely metered water volume in the flush cycle by correcting for pressure and flow variations and for the non linear relationship between low and high flows while the high flow valve 56 opens and closes. In general, in this routine, a correction factor is used to adjust the pulse count to correct for the reduced flow through the high flow valve 56 when it is opening and closing. In addition, the correction factor is adjusted to account for the high flow characteristics and for the measured time required to close the high flow valve 56.

Referring now to the toilet flush routine of FIG. 30, the routine is called for example when the user detection routines of FIGS. 27–29 detect a completed use of the sanitary fixture or by operation of the override switch 39 as described below. The toilet flush routine starts at start block 440 of FIG. 30. The memory 33 includes information used by the microprocessor 32 in controlling a flush cycle, including a total volume of water to be supplied for the flush cycle, the volume to be supplied for the high flow siphon flush part of the cycle and the volume of water to be supplied thereafter for reseal of the fixture trap. Also in memory is a lookup table for use in the flush control routine. Table 1 below is an example of the lookup table.

TABLE 1

| FLUSH VOLUME TENTHS GAL | HI FLOW BASE CNT | BASE INT 80 $\mu$s int | RATE-FACTOR Pulses × 8 | BASE O-T 16 ms int | O-T FACTOR Pulses × 8 |
|---|---|---|---|---|---|
| 10 | 355 | 117 | 6 | 69 | 23 |
| 11 | 377 | 120 | 7 | 77 | 24 |
| 12 | 399 | 123 | 8 | 84 | 25 |
| 13 | 421 | 126 | 8 | 91 | 26 |
| 14 | 443 | 129 | 9 | 98 | 27 |
| 15 | 465 | 132 | 9 | 105 | 28 |
| 16 | 485 | 134 | 10 | 113 | 29 |
| 17 | 507 | 136 | 10 | 119 | 27 |
| 18 | 529 | 137 | 10 | 125 | 25 |
| 19 | 551 | 138 | 10 | 132 | 23 |
| 20 | 573 | 139 | 11 | 139 | 21 |
| 21 | 595 | 140 | 11 | 146 | 19 |
| 22 | 617 | 141 | 11 | 151 | 17 |
| 23 | 640 | 142 | 12 | 156 | 16 |
| 24 | 669 | 142 | 12 | 156 | 16 |
| 25 | 698 | 143 | 12 | 156 | 16 |
| 26 | 727 | 143 | 12 | 156 | 16 |
| 27 | 756 | 144 | 12 | 156 | 16 |
| 28 | 785 | 144 | 12 | 156 | 16 |
| 29 | 814 | 144 | 12 | 156 | 16 |
| 30 | 844 | 145 | 12 | 156 | 17 |
| 31 | 874 | 145 | 12 | 156 | 17 |
| 32 | 904 | 145 | 12 | 156 | 17 |
| 33 | 934 | 145 | 12 | 156 | 17 |
| 34 | 964 | 145 | 12 | 156 | 17 |
| 35 | 994 | 145 | 12 | 156 | 17 |

In block 442 of FIG. 30 the routine accesses the lookup table and finds the table row corresponding to the total volume programmed for the flush cycle. For example, for a total volume of 1.6 gallons, the routine goes to the first (left) column of the table and to the row for a flush volume of 16 tenths of a gallon. The baseline high flow pulse count HF BASE CNT is aligned in the second column, and this count, namely 485 pulses, is returned at block 442. This baseline count entries in column 2 are not linearly related to the volumes of column one. Instead the baseline pulse counts are approximately corrected for the non linear relationship between the high and low flows during the times that the high flow valve 56 is not fully open.

In order to correct the pulse count more precisely for actual conditions and flow characteristics, at block 444 the routine gets an off time pulse correction number O-T CORR stored in memory in the previous flush cycle controlled by the FIG. 30 toilet flush routine. In block 446 the O-T CORR number is added to the base pulse count to obtain a corrected high flow pulse count HF CNT. The increase in the pulse count corrects for variations in valve closing time that may result from the pressure drop when the high flow valve 56 is open or from mechanical properties of the valve such as effective orifice size. When the pulse count is adjusted in block 446, the low flow valve 54 is opened in block 448 and the high flow valve 56 is opened in block 450. Water begins to flow in the low flow path, rotating the turbine spool 142, and at block 452, a count is commenced of the resulting pulses from the Hall effect sensor 152.

The pulse count HF PULSES is compared, at small time intervals represented in block 454, in decision block 456 until the sum of the counted pulses HF PULSES reaches the corrected high flow count HF CNT. Because valve operating time is affected by flow rate, the FIG. 30 routine now makes another correction in the pulse count to correct for the restriction in the flow path through the high flow valve 56 due to factors such as pipe size and the adjustment of the control stop 24. The flow rate determines the interval of time between successive hall effect sensor pulses. In block 458, while the high flow valve is fully open, or opened to the maximum extent permitted in the elapsed cycle time, the interval between pulses PUL INT is measured. In block 460 the routine looks up a baseline pulse interval BASE INT. The baseline interval is found in the third column of Table 1. For the 1.6 gallon example, the base interval is 134 of 80 microsecond time segments or 10.72 milliseconds.

The baseline interval BASE INT is compared at block 462 with the measured interval PUL INT. If there is a difference, then in block 464 the routine returns to the lookup table to get a pulse count correction factor INT CORR. In the 1.6 gallon example, assuming for example that the measured interval is ten time segments of 80 microseconds each more than the baseline amount, the correction factor is 80 pulse counts (error of ten multiplied by the number 10 from column four of the table, divided by eight). In block 466 the flow rate correction factor INT CORR is added to the high flow count HF CNT to obtain a higher pulse count NEW CNT that has the effect of adding to the valve open time to adjust for flow restriction.

The continuing pulse count HF PULSES from block 452 is compared, at small time intervals represented by block 468, in decision block 470 until the sum of the counted pulses HF PULSES reaches the new corrected high flow count NEW CNT. When this number of pulses occurs, a command is issued at block 472 to close the high flow valve 56. At this point in the routine, a measurement is made of the time required for the high flow valve 56 to close. A start time T1 is determined at block 474 at the time of the valve close command of block 472. The closing time measurement is possible because flow through the high flow valve 56 causes a change in the flow rate through the low flow valve 54. When the high flow valve 56 is closed, the flow rate through the low flow valve 54 is relatively high. When the high flow valve 56 is open, the bypass of flow away from the low flow valve 54 causes a decrease in the low flow rate.

As the high flow valve 56 closes, the low flow rate increases and the inter pulse interval becomes progressively shorter. When the high flow valve 56 completely closes, the inter pulse interval becomes constant. This characteristic is used in block 476 where the routine waits for the pulse interval to become constant, When this occurs, it is determined that the high flow valve 56 is closed. This stop time is recorded as time T2 in block 478 and the elapsed time required for valve closing, OFF TIME, is computed in block 480 by subtracting the start time from the stop time.

The fifth column in the lookup table, TABLE 1, provides a baseline off time for closing the valve. In the 1.6 gallon example, the baseline off time BASE O-T is 113 time segments of 16 milliseconds each. The routine gets this baseline off time in block 482, and compares it with the measured off time in block 484. If there is a difference, DELTA O-T, then in block 486 the routine returns to the lookup table and in the sixth (right) column gets the off time correction factor O-T CORR. Again using the 1.6 gallon example, if the measured off time were for example five time segments larger than the baseline of 113 time segments, the correction factor would be 18 pulses (five time segments multiplied by the factor 29 divided by eight). In block 488 this correction factor O-T CORR is stored in memory 33 for use in block 444 during the next FIG. 30 routine.

After the high flow valve 56 is closed and the high siphon flush flow ends, the fixture trap is resealed by a continued low flow through the low flow valve 54. At block 490 the toilet flush routine calls a low flow control routine seen in FIG. 31. When the low flow routine of FIG. 31 is completed, the process returns to the FIG. 30 routine and ends at block 492.

Figure 31:
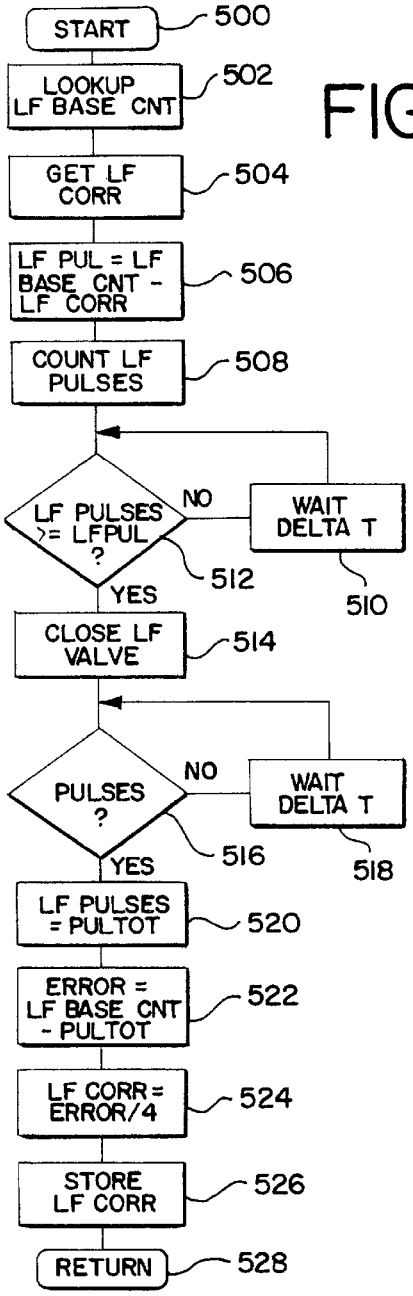
FIG. 31 is a flow chart of a low flow control routine that is used for operating the flush controller for supplying water to reseal the trap of a toilet at the end of a toilet flush operation or to supply water to flush a urinal.

The low flow control routine of FIG. 31 starts at block 500. At block 502 the routine gets from memory 33 a low flow baseline pulse count LF BASE CNT. For a toilet trap reseal flow, the low flow baseline count might be, for example, the number of pulses needed for a trap reseal flow of 0.3 gallon. For example, in a preferred embodiment of the invention the Hall effect sensor 152 provides 2070 pulses per gallon of flow through the low flow valve 54, and the baseline count for 0.3 gallon is 621 pulses.

In block 504 the routine gets from memory 33 a low flow correction factor LF CORR stored in memory during the previous trap reseal flush cycle. As described below, the correction factor prevents excess flow resulting from the delay in closing the low flow valve 54 at the end of the low flow operation. In block 506 a corrected low flow pulse count LF PUL is computed by subtracting the correction factor LF CORR from the baseline count LF BASE CNT.

The low flow valve 54 is open at the start of the routine of FIG. 31 when the routine is called from the FIG. 30 toilet flush control routine. As block 508 indicates, low flow pulses resulting from rotation of the turbine spool 142 are counted from the start of the routine of FIG. 31 and summed as LF PULSES. The low flow pulse count LF PULSES is compared, at small time intervals set in block 510, in decision block 512 until the sum of the counted pulses LF PULSES reaches the corrected low flow count LFPUL. At this time a command is issued at block 514 for closing the low flow valve 54.

When the flush controller 20 is first put in service, the actual flow through the low flow valve 54 is larger than the baseline flow initially stored as LF BASE CNT in memory 33. There is a time lag from this command until the valve 54 closes and prevents further flow. The reason for the initial flow volume overshoot is the continuing flow through the low flow valve 54 during the time required for the valve to close. The routine of FIG. 31 corrects for this initial error, and also corrects for subsequent errors that can arise from changes in conditions such as control stop settings and water supply pressure variations.

In block 516 a test is made at periods set in block 518 for the presence of continuing pulses. When pulses stop due to full closing of the low flow valve 54, a count of the total pulses in the flush cycle is determined in block 520 as PULTOT. The excess flow results in more pulses being counted in PULTOT that are called for kin block 502 as LFPUL. The error ERROR is calculated as the difference in block 522. The correction factor LF CORR of one quarter of the error is calculated in block 524 and is stored in block 526 for use in the next low flow trap reseal cycle. The routine returns to the FIG. 30 routine at block 528.

The same routine of FIG. 31 can be used to control the flush cycle of a urinal when only the low flow valve is used. In this case a command to open the low flow valve would precede or be added to the start of the routine, and a different baseline count would be used. For example for a one gallon urinal flush, the baseline count with a preferred embodiment of the invention would be 2070 pulses. The routine would proceed as described above. At block 526, the error factor LF CORR would be specific for use in a urinal flush process because the correction factors for a small trap reseal volume would be different from the correction factor for a larger urinal flush volume.

The correction factor LF CORR is a fraction of the error rather than the full error amount. This provides stability and avoids problems such as large variations in pulse count due to water flow discontinuities. When the flush controller is first initialized and operated, for example in a urinal flush, the initial value of the correction factor LF CORR is zero. In the next cycle, the correction factor is one-quarter of the measured error. As the process is repeated, the correction factor smoothly approaches a number of pulses subtracted from the baseline count that provides a precise metering of the desired total flow volume.

In normal operation, the flush control system 30 functions to energize and deenergize the solenoids 58 and 60 to carry out the flush cycle. A normal flushing operation or alternatively an emergency or setup flushing operation can be initiated by the override control 36 illustrated in FIGS. 16–20. An override disk lever 258 is pivotally supported on a stem 260 of an override valve 262. The valve 262 and stem 260 are normally held in an upper position seen in FIGS. 16 and 17 by engagement with the spring seat 94. In this position, the override valve 262 closes an override valve port 264 in the cap 86 communicating with the passage 112.

Figure 20:
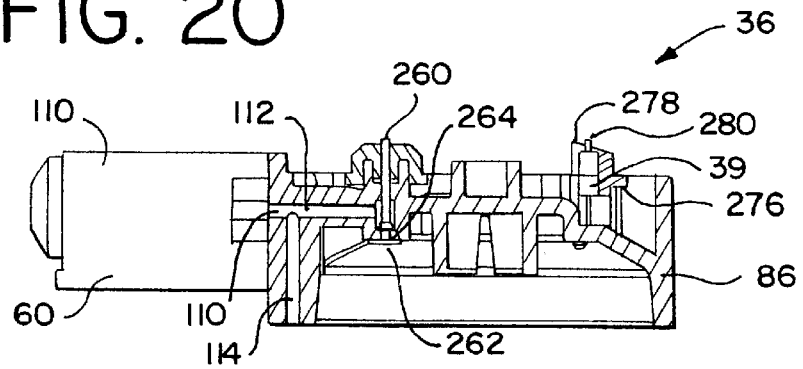
FIG. 20 is an enlarged sectional view of the high flow valve cap and components of the override control of the flush controller.

The override button 38 is received in an opening in an escutcheon 266 threaded onto a retainer hub 268. The retainer hub 268 extends through an opening 269 (FIG. 3) in the top wall of the front cover 42. A resilient seal cup 270 (FIG. 19) is sandwiched between the button 38 and the hub 268 for sealing the interior of the cover 42 and for biasing the button 38 to its upper, normal, standby position seen in FIG. 16. A drive screw 272 (FIG. 19) positions and loosely holds the lever 258 to a stem portion 274 of the button 38. As seen in FIG. 20, the switch 39 is nested in a holder 276 having opposed pivot lugs 278 flanking an actuator nose 280 of the switch 39.

The button 38 can be pressed downward to two different positions with either a light force (FIG. 17) or a substantially stronger force (FIG. 18) to initiate either a normal or an emergency flush. When the user presses the button 38 to a first position seen in FIG. 17, the stem portion 274 of the button 38 presses the lever 258 downward, and the lever pivots about a pivot point defined by the top of the stem 260. The override switch 39 senses this movement of the lever 258 as the lever 258 depresses the nose 280 of the switch 39 and causes the normally closed switch (FIG. 15) to open. The spring force applied by the spring 92 and spring seat 94 against the valve 262 and the stem 260 is large enough to cause the switch nose 280 to be depressed before the stem 260 is moved downwardly. The switch 39 thus functions as a sensing device to detect movement of the button 38 from the normal, standby position of FIG. 16 to the first override position of FIG. 17. Operation of the switch 39 provides a flush initiation signal to the control system 30 through the connector 210 and contacts 204. In response to this signal, the control system 30 carries out a normal flush cycle as represented in FIG. 14. The ability to perform a flush operation during use of a sanitary fixture is a desirable feature. In addition, the ability to carry out a flush operation during installation of the flush controller 20 and adjustment of the control stop 24 is also desirable.

Figure 17:
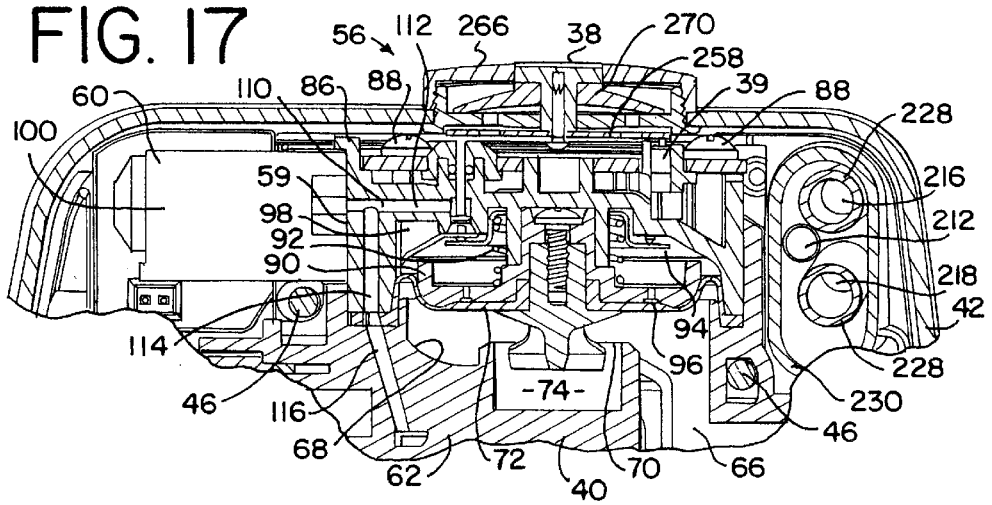
FIG. 17 is a view like FIG. 16 showing the override control operated to a first override position and showing the high flow valve assembly open in a normal flush operation.
Figure 18:
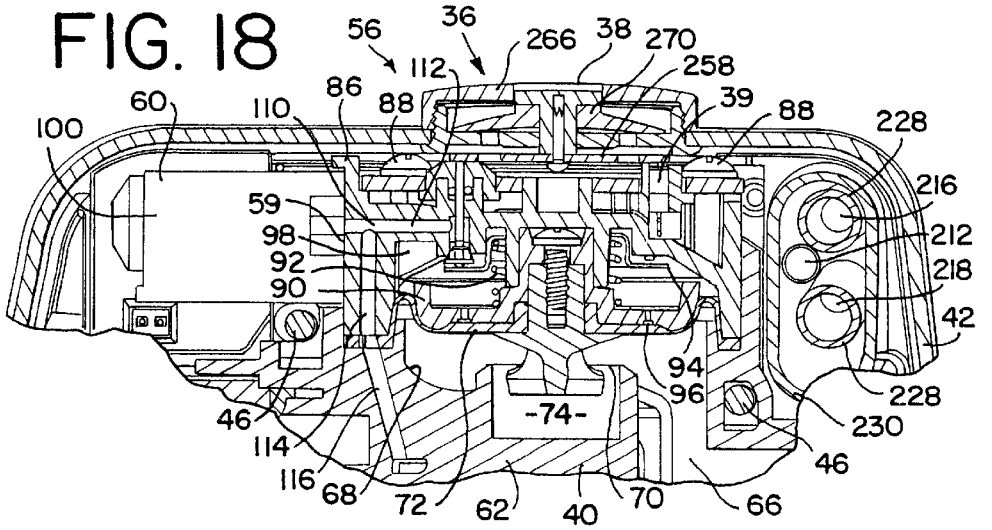
FIG. 18 is a view like FIGS. 16 and 17 showing the override control operated to a second override position and showing the high flow valve assembly open in an emergency or setup flush operation.
Figure 19:
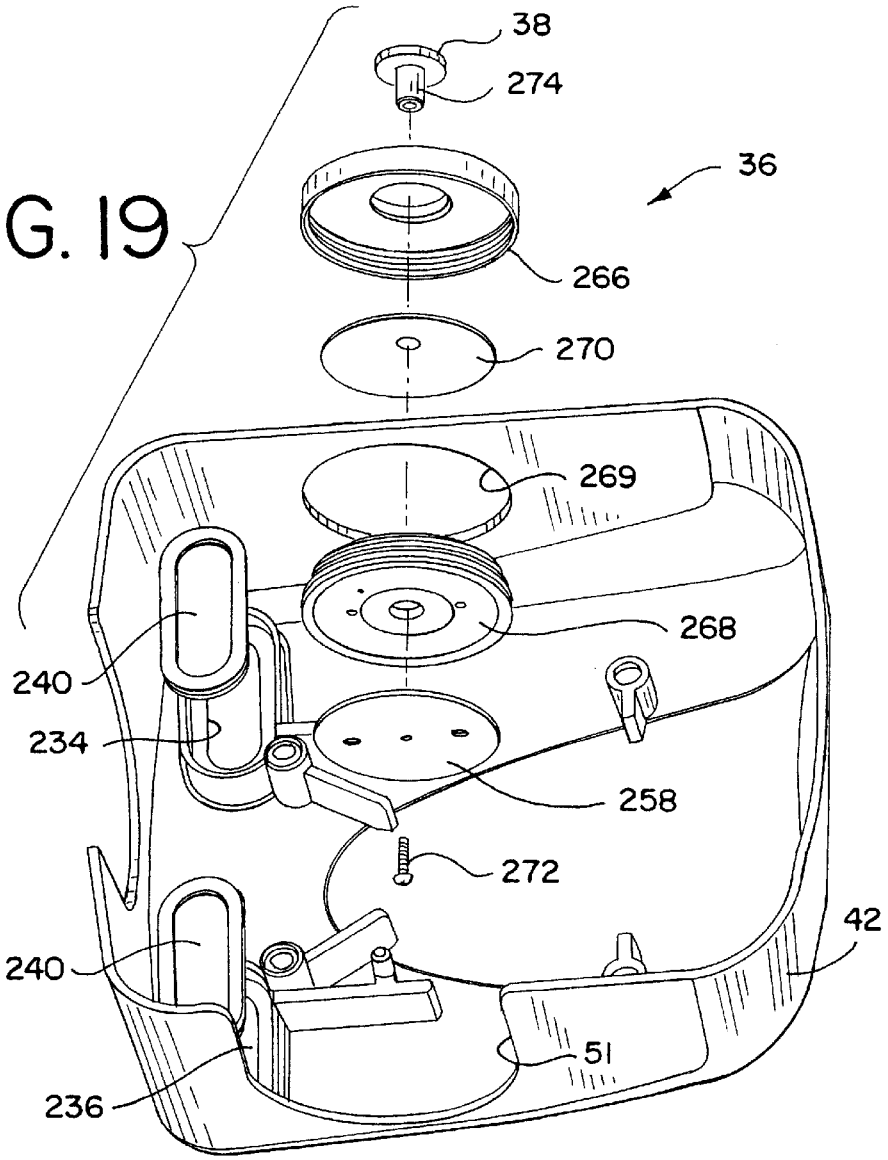
FIG. 19 is an exploded isometric view of the front cover and components of the override control of the flush controller.

If the button 38 is pressed further downward beyond the position of FIG. 17 toward the position of FIG. 18, the lever 258 contacts the lugs 278 of the switch holder 276. The contact with the lugs 278 protects the switch 39 from excessive force and over stroking. If the force applied to the lever 258 is increased sufficiently to overcome the force of the spring 92 and deflect the spring seat 94, the lever 258 pivots about the lugs 278 and forces the stem 260 downward. As a result, the valve port 264 opens to permit water to flow from the control chamber 98 and through passages 112, 114 and 116 to the outlet port 26. The valve 262 and port 264 act as an override pilot valve in parallel flow relation to the high flow solenoid pilot valve 60. When the override pilot 262 opens, the reduction in control chamber pressure causes the high flow valve assembly 56 to open, and water flows at a high rate between the inlet port 22 and the outlet port 26. Because this operation does not use the flush controller 30 or the high flow solenoid pilot valve 60, electrical power is not needed. An emergency flush can be carried out in the event of battery discharge or circuit malfunction. In addition, an installer of the flush controller 20 can manually maintain the high flow valve assembly 56 continuously in an open condition for a sufficient period of time to adjust the control stop 24 to avoid splashing in the sanitary fixture.

Figure 23:
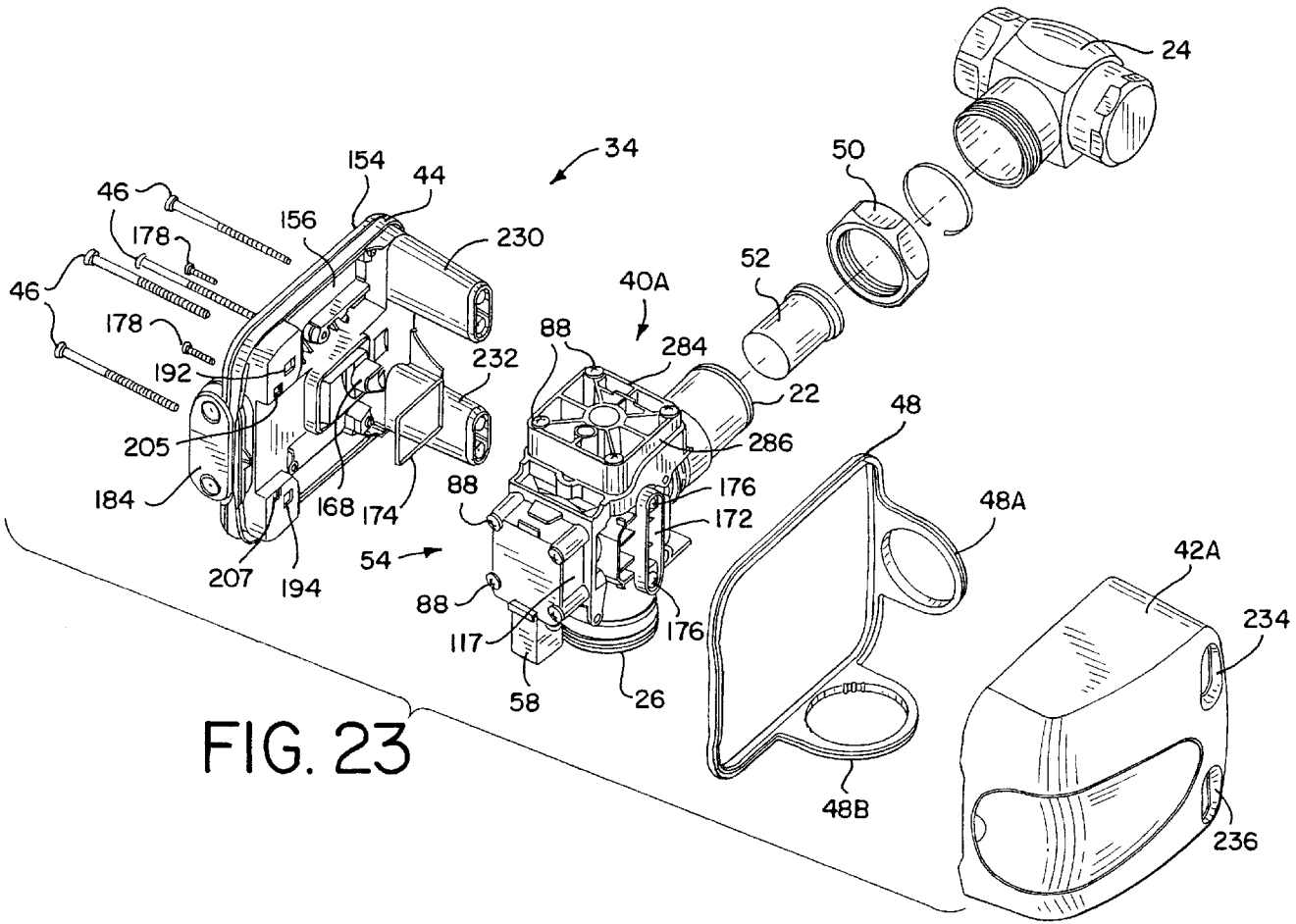
FIG. 23 is an exploded isometric view, similar to FIG. 5, illustrating the flush controller configured to flush a urinal rather than a toilet.

As described above and as illustrated in FIGS. 1–7 and 14–20, the flush controller 20 is configured to supply flushing water to a siphon flush toilet requiring an initial burst of water at a high flow rate for flushing the fixture followed by a low flow rate water delivery for resealing the fixture trap. The flush controller 20 can alternatively be configured to supply flushing water to a urinal requiring a measured flow of water at a constant low flow rate. In this configuration, as seen in FIGS. 23 and 24, the high flow valve assembly 56 and the override control 36 are omitted from the flush controller 20. Many other components are common to both configurations.

Referring to the urinal configuration seen in FIGS. 23 and 24, a front cover 42A is similar to the front cover 42 of the toilet version but lacks the top opening for the override button 38 and associated elements. A valve body assembly 40A is similar to the valve body assembly 40 of the toilet version but lacks the components of the high flow valve assembly 56, including the high flow valve cap 86 and the high flow solenoid 60.

In place of the high flow valve cap 86 and the high flow valve member 72, in the urinal version of FIG. 23, the high flow valve cavity 68 at the top of the valve body 62 is closed and sealed by a plug assembly 284 attached to the body 62 by fasteners 88. As seen in FIG. 24, the plug assembly includes a body 286 with an exterior shape similar in some respects to the high flow valve cap 86 and a sealing diaphragm 288 similar in some respects to the high flow valve 72. When the plug assembly is installed and held with the fasteners 88, the imperforate diaphragm 288 seats against the high flow valve seat 70 and seals the cavity 68.

Figure 10:
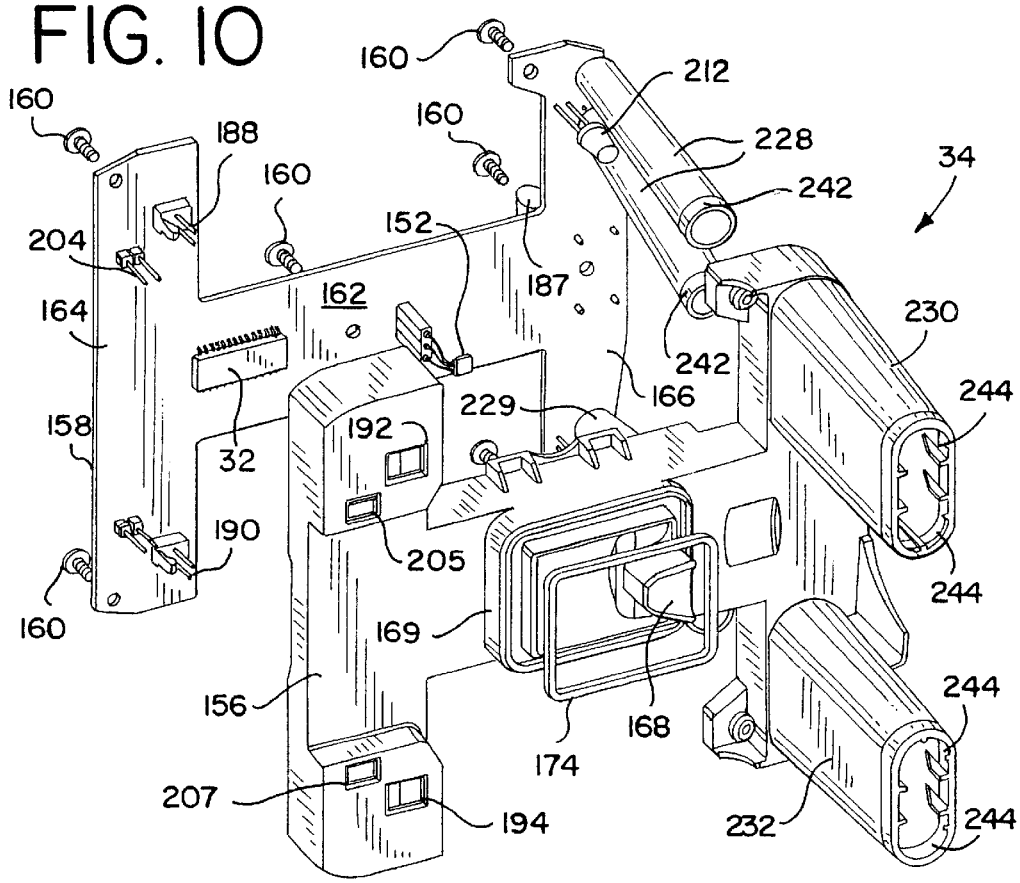
FIG. 10 is an exploded front isometric view of the electronics enclosure of the back plate assembly.
Figure 11:
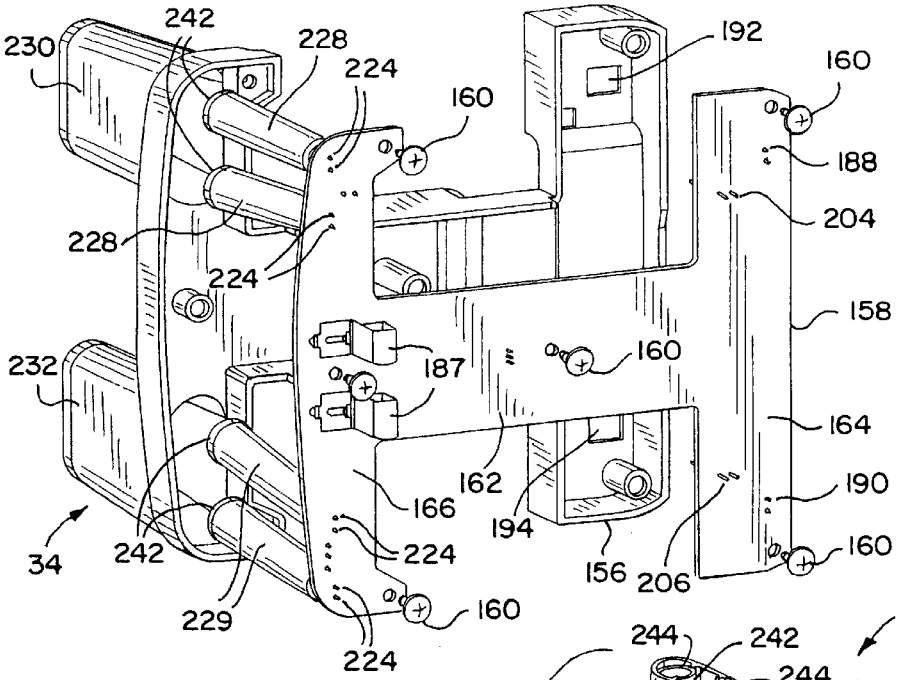
FIG. 11 is an exploded rear isometric view of the electronics enclosure of the back plate assembly.
Figure 12:
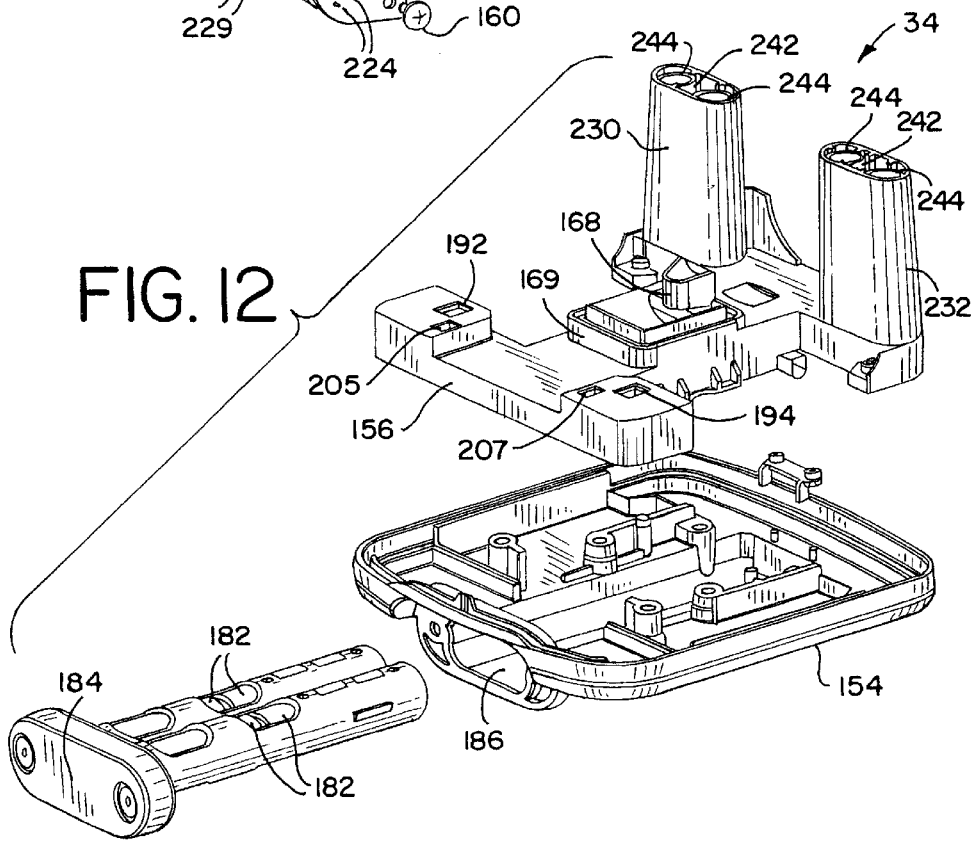
FIG. 12 is an exploded isometric view of the back plate assembly of the flow controller.

When the components of the urinal version of FIG. 23 are assembled, the cable 200 and connector 202 (FIGS. 8 and 15) are connected through the window 194 to the terminal pins 190 on the circuit board 158 (FIGS. 10 and 15). This connection permits the flush control circuit to energize the low pressure solenoid 58 in order to open the low pressure valve assembly 54 and provide a low flow rate supply of water to the outlet port 26. This flow is measured by the flow sensing assembly 28. Because the high flow valve solenoid 60 is not present in the urinal configuration, there are no connections made to the terminal pins 188 through the window 192. Because the override switch 39 is not present in the urinal configuration, there are no connections to the terminal pins 204 or the terminal pins 206 through the window 205 or the window 207. Both the toilet and the urinal versions use the same circuit board 158 with the same components. The terminal pin connection pattern for a urinal differs from the terminal pin configuration for a toilet. This difference can be used by the flush control 30 at the time of installation or setup of the flush controller to detect whether the controller is configured for a toilet or for a urinal, and to tailor the flush control procedure accordingly.

Figure 25:
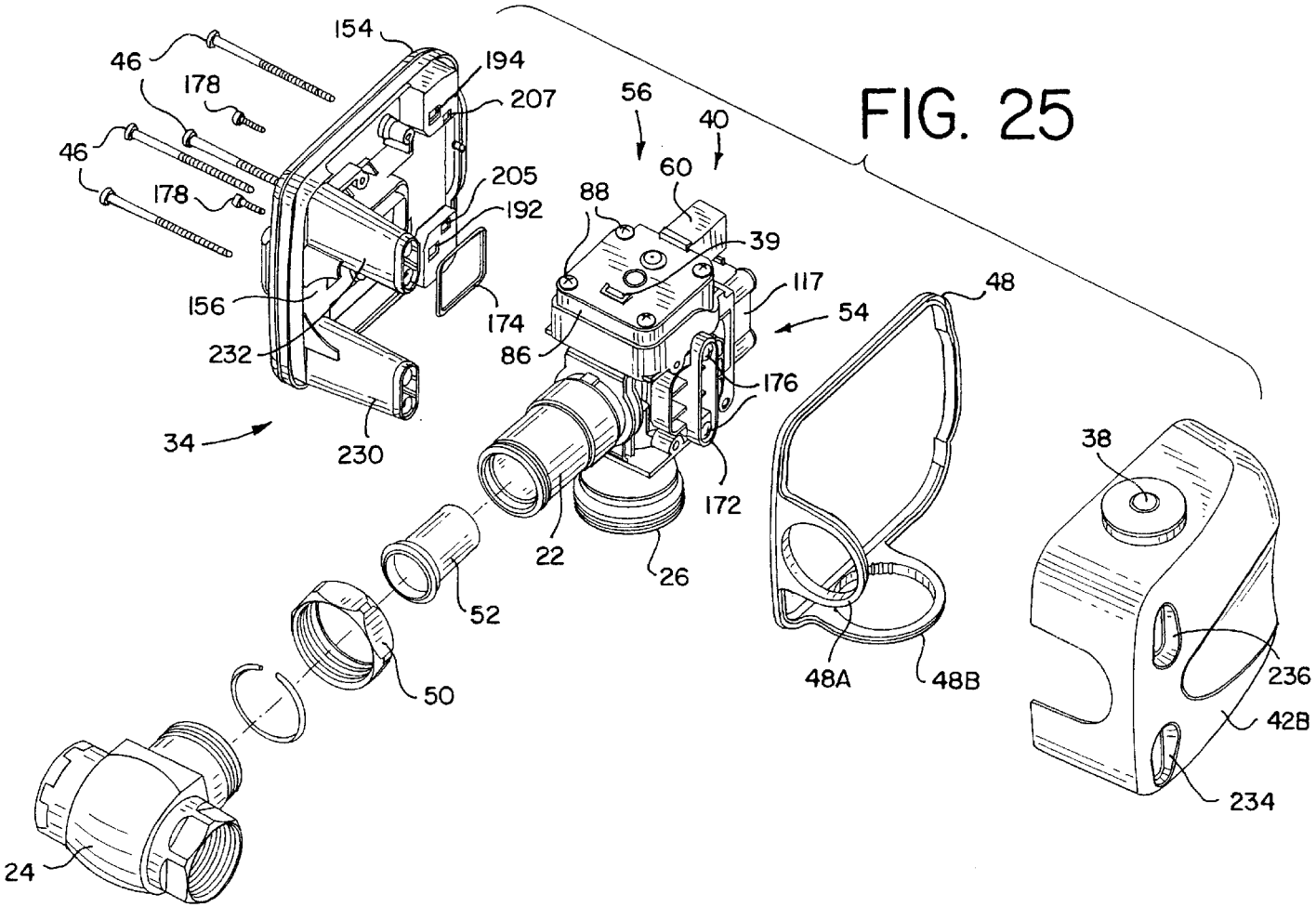
FIG. 25 is an exploded isometric view, similar to FIG. 5, illustrating the flush controller configured for a water supply connection on the left side rather than the right side of the flush controller.

As illustrated in FIGS. 1–7 and 14–20, the flush controller 20 is configured with the inlet port 22 at the right, for connection through the control stop 24 to a water supply conduit located at the right side of the flush controller 20. As illustrated in FIG. 25, and comparing FIGS. 5 and 25, the flush controller can be configured for a left side water supply. The change in configuration is accomplished by changing the orientation of the valve body assembly 40 and of the back plate assembly 44 of the flush controller.

Figure 5:
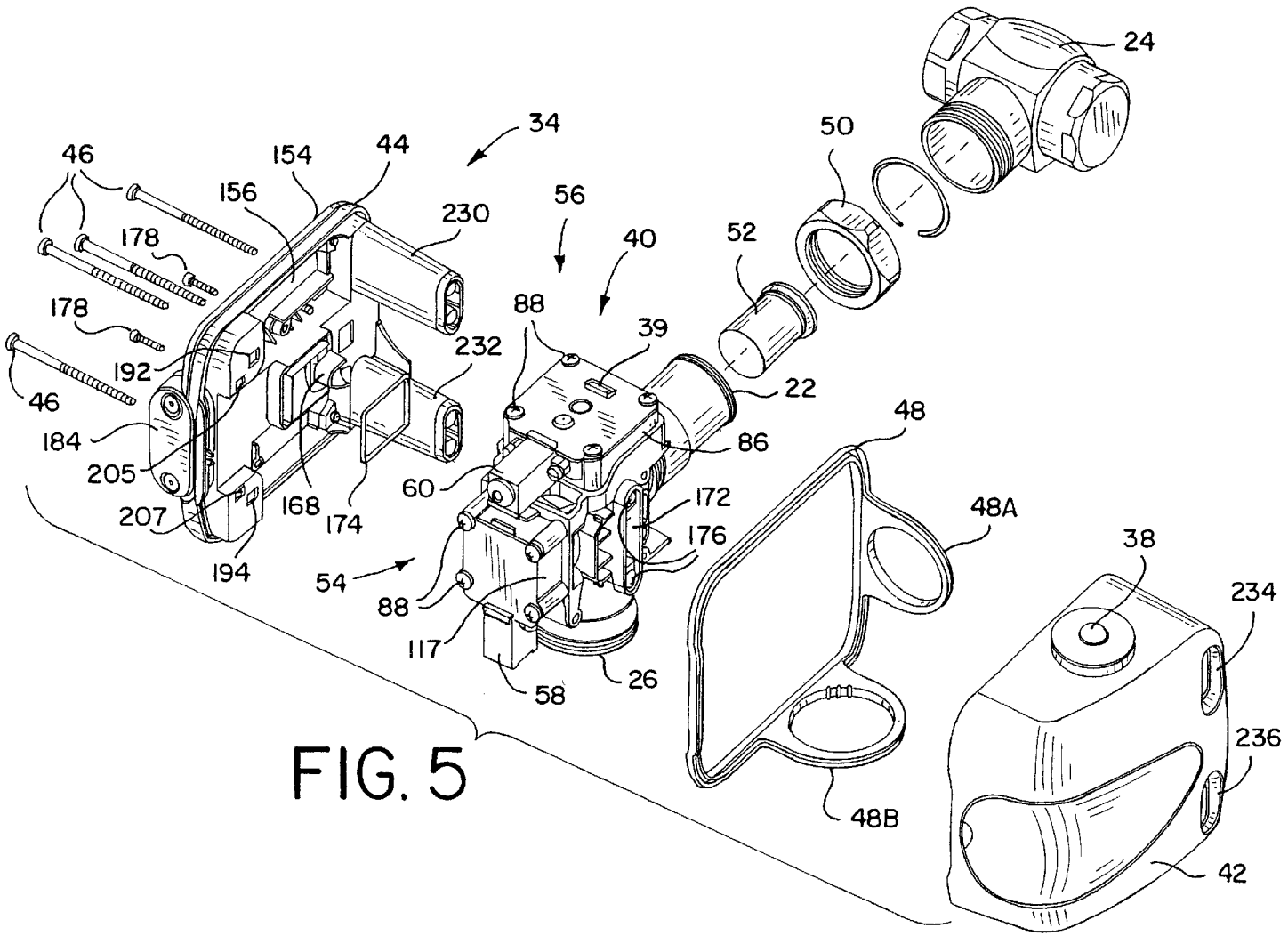
FIG. 5 is an exploded isometric view of the flush controller showing the valve body assembly separated from the back plate assembly, the gasket and cover subassembly and the control stop.
Figure 6:
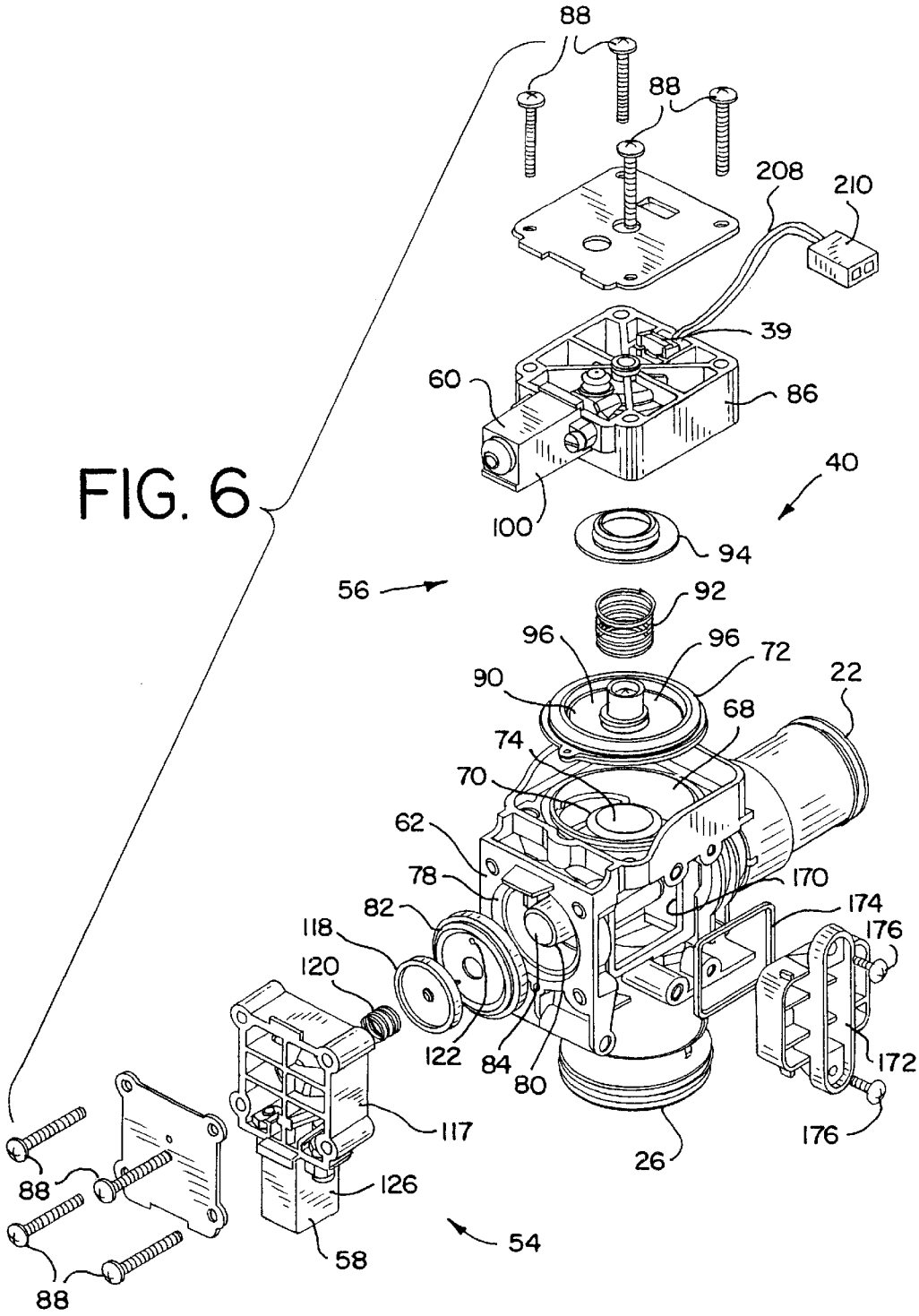
FIG. 6 is an exploded isometric view of the valve body assembly of the flush controller.

For a left side water entry, the valve body assembly 40 is rotated from the orientation of FIG. 5 one-hundred-eighty degrees around the vertical Z axis of FIG. 21. This places the inlet port 22 at the left side of the valve body assembly 40. The bulkhead member 172 is attached by fasteners 176 to close the window 170 that in this configuration is at the front of the valve body 62. The high flow valve assembly 56 is at the top of the valve body 62 with the override switch 39 toward the left side of the assembly 40, rather than toward the right side as seen in FIG. 5. The high flow solenoid pilot valve 60 is located at the right side of the assembly 40, rather than the left side as in FIG. 5. The low flow valve assembly 54 and the low flow solenoid pilot valve 58 are located at the right side of the body 62, opposite the inlet port 22. The left side entry configuration uses a front cover 42B with the outlet port opening 51 and the override hub opening 269 reversed.

For the left side water entry configuration of FIG. 25, the back plate assembly 44, including the electronics enclosure 156 and the circuit board 158, is rotated from the orientation of FIG. 5 one-hundred-eighty degrees around the horizontal Y axis of FIG. 21. Upon assembly, the centrally located sensor well 168 containing the Hall effect sensor 152 is received in the window 170 at the rear of the valve body 62 and is sealed by gasket 174. The user detection system 34 is located at the left side of the flush controller 20. The tower 232 and detectors 220 and 222 are located above the tower 230 and emitters 216 and 218. The array of intersection points 251–254 of the user detection system 34 (FIGS. 21 and 22) is inverted, but this does not change the pattern in which these points are arrayed in the user detection field 247 or the function of the user detection system 34. The terminal pin windows 194 and 207 are at the top and right of the electronics enclosure 156, rather than at the bottom left as seen in FIG. 5. The terminal pin windows 192 and 205 are at the bottom right of the electronics enclosure 156 rather than at the top left as seen in FIG. 5.

When the components of the left side water supply entry configuration of FIG. 25 are assembled, the cable 208 and the connector 210 for the override switch 39 are connected through the window 207 to the terminal pins 206 (FIG. 10), rather than through the window 205 to the terminal pins 204 as in FIG. 5. The cable 196 and connector 198 for the high flow valve solenoid 60 are connected through the window 194 to the terminal pins 190, rather than through the window 192 to the terminal pins 188 as in FIG. 5. The cable 200 and connector 202 for the low flow solenoid valve 58 are connected through the window 192 to the terminal pins 188, rather than through the window through the window 194 to the terminal pins 190 as in FIG. 5. Thus, the terminal pin connection pattern for left side water entry differs from the terminal pin configuration for right side water entry. This difference can be used by the flush control system 30 at the time of installation or setup of the flush controller 20 to detect whether the controller is configured for right or left water supply entry, and to tailor the flush control procedure accordingly.

The flush controller can also be configured for a urinal, as in FIG. 23, but with left side water supply, as in FIG. 25. Any of the four different configurations, toilet with left water supply, toilet with right water supply, urinal with left water supply, and urinal with right water supply, is easily assembled at the time of manufacture. For either toilet configuration, the overflow switch 39 and the high flow valve assembly 56 are used. For either urinal configuration, the overflow switch 39 and the high flow valve assembly 56 are omitted. For right side water supply of either a toilet or a urinal, the valve body assembly 40 or 40A and the back plate assembly 44 are oriented as seen in FIGS. 5 and 23. For left side water supply of either a toilet or a urinal, the valve body assembly 40 or 40A and the back plate assembly 44 are oriented as seen in FIG. 25. The ability to use and simply reorient common parts in all configurations is an important advantage.

The connections to the circuit board terminal pins are unique for each of the four possible configurations of the flush controller 20*o*. The four configuration variations, with the terminal pin/cable connections to enclosure window/terminal pins are seen in the following table.

TABLE 2

| | High Flow Solenoid 60 Cable 196, Connector 198 Connected to: | | Low Flow Solenoid 58 Cable 200, Connector 202 Connected to: | | Override Switch 39 Cable 208, Connector 210 Connected to: | |
|---|---|---|---|---|---|---|
| Configuration | Window | Terminal Pins | Window | Terminal Pins | Window | Terminal Pins |
| Toilet, Right | 192 | 188 | 194 | 190 | 205 | 204 |
| Toilet, Left | 194 | 190 | 192 | 188 | 207 | 206 |
| Urinal, Right | None | None | 194 | 190 | None | None |
| Urinal, Left | None | None | 192 | 188 | None | None |

At the time of initialization of the flush control system 30, the terminal pin connection pattern is interrogated to determine whether the flush controller 20 is configured as a toilet with right side water supply, as toilet with left side water supply or as a urinal. This information is used by the control system 30 to tailor the operation of the flush controller 20 to each specific configuration. If the controller is configured as a urinal, only the low flow solenoid pilot valve 58 is used, and this valve is connected to either the pins 188 or the pins 190, with the other set of terminal pins being unterminated. In this case, the control system 30 applies low flow solenoid operating signals to both sets of terminal pins 188 and 190 for low flow urinal operation. For a right entry toilet configuration, the control system 30 applies high flow solenoid pilot valve operating signals to the terminal pins 188 and low flow solenoid pilot valve operating signals to the terminal pins 190 and looks for override switch input at terminals 204. Conversely, for a left entry toilet configuration, the control system 30 applies high flow solenoid pilot valve operating signals to the terminal pins 190 and low flow solenoid pilot valve operating signals to the terminal pins 188 and looks for override switch input at terminals 206.

The differences in the terminal pin connections seen in Table 2 can be used in various ways to detect the flush controller configuration. In the preferred embodiment of the invention, the terminal pins 204 and 206 for the normally closed override switch 39 are tested for the presence and location of an override switch. If no override switch 39 is present, the controller 20 is determined to be configured as a urinal. If an override switch 39 is connected to a terminal pin 204, the controller 20 is determined to be configured as a toilet with a right side water supply. If an override switch 39 is connected to a terminal pin 206, the controller 20 is determined to be configured as a toilet with a left side water supply.

Figure 32:
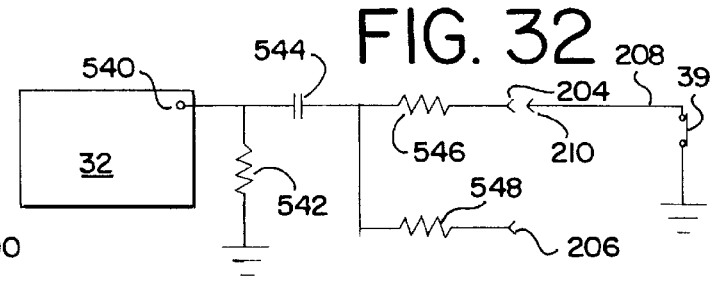
FIG. 32 is a schematic diagram of a circuit for determining the configuration of the flush controller by detecting the presence and location of a manual override switch.

FIG. 32 illustrates a circuit used to detect and locate the normally closed override switch 39. The microprocessor 32 includes a tri-port 540 that is software controlled to be in a high state of, for example, four volts, of a low state of zero volts, or to be an input port. In the circuit of FIG. 32, the flush controller 20 is configured as a right entry toilet and the normally closed override switch 39 is connected by the cable 208 and the connector 210 between ground and the terminal pin 204. Depending on the configuration of the flush controller 20, the grounded, normally closed switch 39 could alternatively be connected to the terminal pin 206 (left entry toilet) or could be not connected to either terminal 204 or 206 (urinal configuration). The microprocessor port 540 is connected to ground by a resistor 542 and is connected through a capacitor 544 to a pair of resistors 546 and 542 connected in parallel to the terminal pins. The resistors 546 and 548 have different values.

Figure 33:
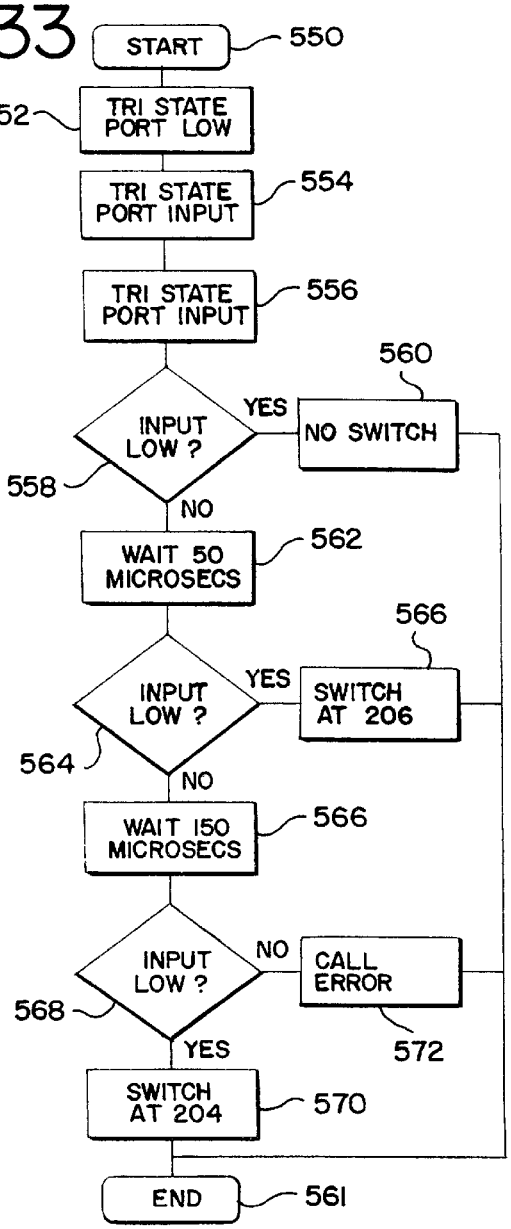
FIG. 33 is a flow chart of a configuration detection routine using the circuit of FIG. 32.

A routine for testing for the override switch 39 using the circuit of FIG. 32 is illustrated in FIG. 33. The routine starts at block 550 and at block 552 the port 540 is placed in a low state of zero volts to assure that there is no charge on the capacitor 544. Then at block 554 the port 540 is placed in a high state of four volts to charge the capacitor 544, which may be a 0.01 microfarad capacitor. At block 556 the port 540 is switched to the input state.

Resistor 546 is larger than resistor 548. Preferably resistor 546 is a 100K resistor and resistor 548 is a 2.2K resistor. Resistor 542 is preferably substantially larger than both, with a preferred value of 1M. When the switch 39 is connected to the terminal pin 206, the capacitor 544 discharges relatively quickly through the lower value resistor 548. When the switch 39 is connected to the terminal pin 204, the capacitor 544 discharges more slowly through the larger resistor 546. When neither terminal pin 204 or 206 is connected to ground through the switch 39, the high port 540 at block 554 does not charge the capacitor 544.

In block 558 of the switch detection routine the input port 540 is tested immediately after the high state of port 540 for a low voltage. If the capacitor 544 has no charge at this time, the determination is made at block 560 that the switch 39 is not connecting either terminal pin 204 or 206 to ground and that the flush controller 20 is configured as a urinal. In this case the routine ends at block 561.

If a high voltage (no low voltage) is seen at block 558, the determination is made that the capacitor 244 is charged and the routine delays at block 562 for 50 microseconds. After this short delay, the input port 540 is again interrogated for a low voltage state at block 564. If a low voltage is detected after this short delay, the determination is made at block 566 that the capacitor 244 is discharged through the small resistor 548 and that the switch 39 is connected to the terminal pin 206. As a result the determination is made that the flush controller 20 is configured as a toilet with a left side water entry and the routine ends at block 561.

If a high voltage (no low voltage) is seen at block 564, the determination is made that the capacitor 244 is still in a charged condition and the routine delays again, for a longer time of 150 microseconds at block 566. The longer delay is sufficient for the capacitor 544 to discharge through the larger resistor 546. After this longer delay, the input port 540 is again interrogated for a low voltage state at block 568. If a low voltage is detected after the accumulated delay, the determination is made at block 570 that the capacitor 244 is discharged through the large resistor 546 and that the switch 39 is connected to the terminal pin 204. As a result the determination is made that the flush controller 20 is configured as a toilet with a right side water entry and the routine ends at block 561. If the port 540 remains high after this longer period, an error condition is present as indicated at block 572.

While the present invention has been described with reference to the details of the embodiment of the invention shown in the drawing, these details are not intended to limit the scope of the invention as claimed in the appended claims.

What is claimed is:

1. A method for flushing a sanitary fixture comprising:

opening a low flow valve between a water supply and the sanitary fixture;

opening a high flow valve between the water supply and the sanitary fixture;

keeping a running count of flow through the low flow valve;

commanding a closing the high flow valve when the running count reaches a closing count; and developing the closing count by using a baseline count derived from a proportional flow relationship between the valve open flow rates of the high and low flow valves, and from an added correction factor to account for nonproportional flows when the high flow valve is partly open.

2. The method of claim 1 further comprising measuring the flow rate of the low flow valve immediately prior to said commanding step and adjusting said baseline count based on the measured flow rate.

3. The method of claim 2, said adjusting step including comparing the measured flow rate with a baseline flow rate and using the difference to select a baseline count adjustment.

4. The method of claim 1, further comprising timing the interval required for the high flow valve to move from open to closed after said commanding step; and modifying the baseline count based on the time of the interval.

5. The method of claim 4, said modifying step including comparing the timed interval with a baseline interval and using the difference to select a baseline count modification.

6. The method of claim 5 further comprising measuring the flow rate of the low flow valve immediately prior to said commanding step and adjusting said baseline count based on the measured flow rate.

7. The method of claim 6, said adjusting step including comparing the measured flow rate with a baseline flow rate and using the difference to select a baseline count adjustment.

8. The method of claim 7 further comprising consulting a lookup table containing the baseline count, the baseline flow rate and the baseline interval.

9. The method of claim 8, said consulting step including using a predetermined flush flow volume to find an entry in the lookup table having the baseline count, the baseline flow rate and the baseline interval corresponding to the predetermined flush flow volume.

10. The method of claim 1 further comprising leaving the low flow valve open following said commanding step, keeping an additional count of the flow through the low flow valve following the commanding step, and directing the low flow valve to close after the additional count reaches a given amount.

11. The method of claim 10 including comparing the count of flow following the commanding step with the given amount and correcting the given amount to account for flow while the low flow valve is closing after said directing step.

12. A method of controlling a siphon flush flow and a trap reseal flow to a sanitary fixture, said method comprising:

opening both a high flow valve and a low flow valve disposed in parallel high and low flow paths between a water supply and the sanitary fixture;

sensing flow through the low flow path;

determining the sum of the flows through the low and high flow paths using the sensed flow through the low flow path and using a proportional flow restriction relationship of the high and low flow paths;

correcting the sum of the flows to compensate for the nonproportional reduced flow through the high flow path when the high flow valve is partly open; and closing the high flow valve when the corrected sum reaches a volume equal to a desired siphon flush flow volume.

13. A method as claimed in claim 12 further comprising correcting the sum of the flows to correct for the rate of flow through the low flow valve immediately prior to said closing step.

14. A method as claimed in claim 13 further comprising correcting the sum of the flows to correct for the time interval required for closing of the high flow valve.

15. The method of claim 14, further comprising maintaining the low flow valve open after said high flow valve closing step to provide a continuing trap reseal flow;

measuring the flow through the low flow path after said high flow valve closing step; and closing the low flow valve when the measured flow reaches a volume equal to a desired trap reseal flow volume.

16. The method of claim 15, further comprising correcting the measured flow to correct for flow during the time required for closing of the low flow valve.

17. A method for detecting a user in a user detection field in front of a flush controller for a sanitary fixture, said method comprising the steps of:

emitting light into spaced apart locations in the user detection field;

sensing a first amplitude of light reflected from a first of the spaced locations in the user detection field;

sensing a second amplitude of light reflected from a second of the spaced locations in the user detection field;

determining a ratio of the sensed first and second amplitudes; and using the ratio of amplitudes to find the location of a user in the user detection field.

18. The method for detecting a user as claimed in claim 17, said emitting step including directing a plurality of beams of light along different light paths into the user detection field.

19. The method for detecting a user as claimed in claim 18, said sensing step comprising aiming a plurality of light detectors in different directions into the user detection field to intersect the light paths at a plurality of points arrayed in the user detection field.

20. The method for detecting a user as claimed in claim 17, said sensing step comprising aiming a plurality of light detectors in different directions into the user detection field.

21. The method for detecting a user as claimed in claim 17, said using step including comparing the ratio with a reference number representing a user located in the user detection field.

22. A method for controlling the initiation of a flush operation of a sanitary fixture comprising:

(a) repeatedly performing a user location routine including:

(i) emitting light along a plurality of different light paths extending into a user detection field near the sanitary fixture;

(ii) aiming a plurality of detectors along different detection paths into the user detection field to intersect the light paths at an array of spaced detection locations;

(iii) sensing the amounts of light reflected at the arrayed locations;

(iv) determining a plurality of ratios of the sensed amounts of light;

(v) comparing the determined ratios with a series of reference numbers corresponding to the presence of a user at predetermined locations in the user detection field;

(vi) concluding that a user is present in the user detection filed if there is match between a determined ratio and a reference number and concluding that no user is present in the user detection field if there is no match between a determined ratio and a reference number;

(b) counting the time that a user remains in the user detection field until a first predetermined time elapses;

(c) after said counting step, summing the time that no user is present in the user detection field until a second predetermined time elapses immediately after the first predetermined time; and (d) initiating a flush operation if both said counting and summing steps are completed.

23. A method as claimed in claim 22, said emitting step including energizing infra red light emitting diodes, and said aiming step including aiming infra red detectors.

24. A method for adapting a flush controller for toilet and urinal applications and for right or left water supply installations;

the flush controller having a valve assembly including a valve body with a vertically extending outlet port and a horizontally extending inlet port, a low flow valve located at a first region of the valve assembly, a high flow valve receiving location at a second region of the valve assembly, and a override switch receiving location at a third region of the valve assembly; the low flow valve having a low flow valve electrical connector, the flush controller optionally having a high flow valve with a high flow valve electrical connector at the high flow valve receiving location and optionally having an override switch with a switch connector at the override switch receiving location;

the flush controller further having an electrical circuit board including a plurality of electrical terminals arrayed at spaced locations over the surface of the circuit board;

said method comprising:

omitting the high flow valve for urinal applications and mounting the high flow valve at the high flow valve receiving location for toilet applications;

rotating the valve assembly around a vertical axis to point the inlet port either to the right or the left;

connecting the low flow valve electrical connector to circuit board terminals adjacent the first region of the valve assembly;

if the high flow valve is present, then connecting the high flow valve electrical connector to circuit board terminals adjacent the second region of the valve assembly; and initializing a control circuit for the flush controller by testing the circuit board electrical terminals for the presence or absence of the override switch.

25. The method of claim 24 further comprising testing the circuit board terminals for the location of the override switch.

26. A method for configuring and operating a flush controller for toilet or urinal control with right or left water inlet, said method comprising:

positioning a valve assembly so that an inlet of the valve assembly is directed either to the right or to the left for a corresponding right or left water inlet connection;

orienting a circuit board having an array of electrical terminals in one of two positions for a right or left water inlet connection respectively;

interconnecting electrical components of the valve assembly to selected terminals of the circuit board in a plurality of different connection patterns for a plurality of different flush controller configurations;

testing the array of circuit board terminals to detect a connection pattern corresponding to a flush controller configuration; and initializing a flush controller operating system with information about the connection pattern.

27. A method as claimed in claim 26 further comprising connecting a low flow valve of the valve assembly to circuit board terminals for all flush controller configurations, connecting a high flow valve of the valve assembly to circuit board terminals for right and left water inlet toilet configurations, and omitting high flow valve connections for urinal configurations.

28. A method as claimed in claim 27 further comprising:

connecting a manual override switch in the valve assembly to circuit board terminals for toilet configurations and not for urinal configurations; and said testing step including checking the circuit board terminals for a connection to the override switch;

identifying a urinal flush controller configuration if the override switch is absent and identifying a toilet flush controller configuration if the override switch is present.

29. A method as claimed in claim 28 further comprising:

connecting the manual override switch to a first circuit board terminal for a right inlet connection toilet configuration and connecting the manual override switch to a second circuit board terminal for a left inlet connection toilet configuration;

said testing step including interrogating the first and second circuit board terminals to determine the water inlet connection direction of a flush controller toilet configuration.

* * * * *